US006793469B2

(12) United States Patent
Chung

(10) Patent No.: US 6,793,469 B2
(45) Date of Patent: Sep. 21, 2004

(54) INFLATABLE PRODUCT EQUIPPED WITH PUMP

(75) Inventor: Wang Cheng Chung, Taipei (TW)

(73) Assignee: Team Worldwide Corporation, Taipei (TW)

( * ) Notice: Subject to any disclaimer, the term of this patent is extended or adjusted under 35 U.S.C. 154(b) by 0 days.

(21) Appl. No.: 09/738,331

(22) Filed: Dec. 18, 2000

(65) Prior Publication Data

US 2001/0026763 A1 Oct. 4, 2001

Related U.S. Application Data

(63) Continuation-in-part of application No. 09/542,477, filed on Apr. 4, 2000.

(51) Int. Cl.[7] ..... F04B 17/00; F04B 19/00
(52) U.S. Cl. ..... 417/411; 417/238; 417/423.15
(58) Field of Search ..... 417/239, 238, 417/411, 423.15, 423.11, 423.14; 5/706, 413 AM, 945

(56) References Cited

U.S. PATENT DOCUMENTS 4,390,226 A * 6/1983 Hohn ..... 439/261
4,619,481 A 10/1986 Grudzinskas
4,766,628 A * 8/1988 Walker ..... 5/706
4,862,533 A * 9/1989 Adams, III ..... 5/413 R
4,890,344 A 1/1990 Walker
4,977,633 A 12/1990 Chaffee
5,020,517 A * 6/1991 Foster et al. ..... 601/57
5,127,808 A * 7/1992 Nichols et al. ..... 417/411
5,249,319 A 10/1993 Higgs
5,267,363 A * 12/1993 Chaffee ..... 5/710
5,367,326 A 11/1994 Pond et al.
5,503,618 A * 4/1996 Rey ..... 601/15
5,522,337 A * 6/1996 Meyers et al. ..... 114/312
5,542,136 A 8/1996 Tappel
5,605,482 A * 2/1997 Choy ..... 441/106
5,687,438 A 11/1997 Biggie et al.
5,711,041 A * 1/1998 Chen ..... 5/708
5,890,882 A * 4/1999 Feldman ..... 417/411
5,931,207 A * 8/1999 Gianino ..... 141/382
5,941,272 A 8/1999 Feldman
6,014,784 A 1/2000 Taylor et al.
2001/0044969 A1 11/2001 Chaffee

* cited by examiner

*Primary Examiner*—Edward K. Look
*Assistant Examiner*—Timothy P. Solak
(74) *Attorney, Agent, or Firm*—Quintero Law Office

(57) ABSTRACT

An inflatable product includes an inflatable body, a socket, an electric pump, at least one battery and a connector. The socket is built in the inflatable body. The electric pump is connected to the socket to pump the inflatable body. The battery is disposed in the electric pump. The connector is provided on the electric pump for connecting an external power. The electric pump is supplied with power by the battery or the external power.

17 Claims, 25 Drawing Sheets

INFLATABLE PRODUCT EQUIPPED WITH PUMP

CROSS REFERENCE TO RELATED APPLICATION

This is a continuation-in-part application of U.S. patent application Ser. No. 09/542,477, filed Apr. 4, 2000.

BACKGROUND OF THE INVENTION

1. Field of the Invention

The present invention relates in general to an inflatable product provided with a built-in battery case and socket.

2. Description of the Related Art

Referring to FIGS. 1A and 1B, a conventional electric pump 14 for inflating an airbed has a fan and motor 142 inside. A plurality of batteries 144 are loaded into the electric pump 14 to supply the power. The airbed 10 is provided with a valve 12. In operation, the electric pump 14 is connected to the value 12 in direction B and then rotated in direction A to fasten the connection between the electric pump 14 and the airbed 10. Then, the airbed 10 is pumped by the electric pump 14.

SUMMARY OF THE INVENTION

An object of the present invention is to provide a modified airbed, which is inflated and deflated in a different way from the conventional way mentioned above.

The airbed of the present invention includes an inflatable body, a socket, an electric pump and a battery case. The socket is built in the airbed. The electric pump is detachably connected to the socket to pump the airbed. The battery case is also built into the airbed for ease of loading batteries that supply the electric pump with power.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Figure 1A:
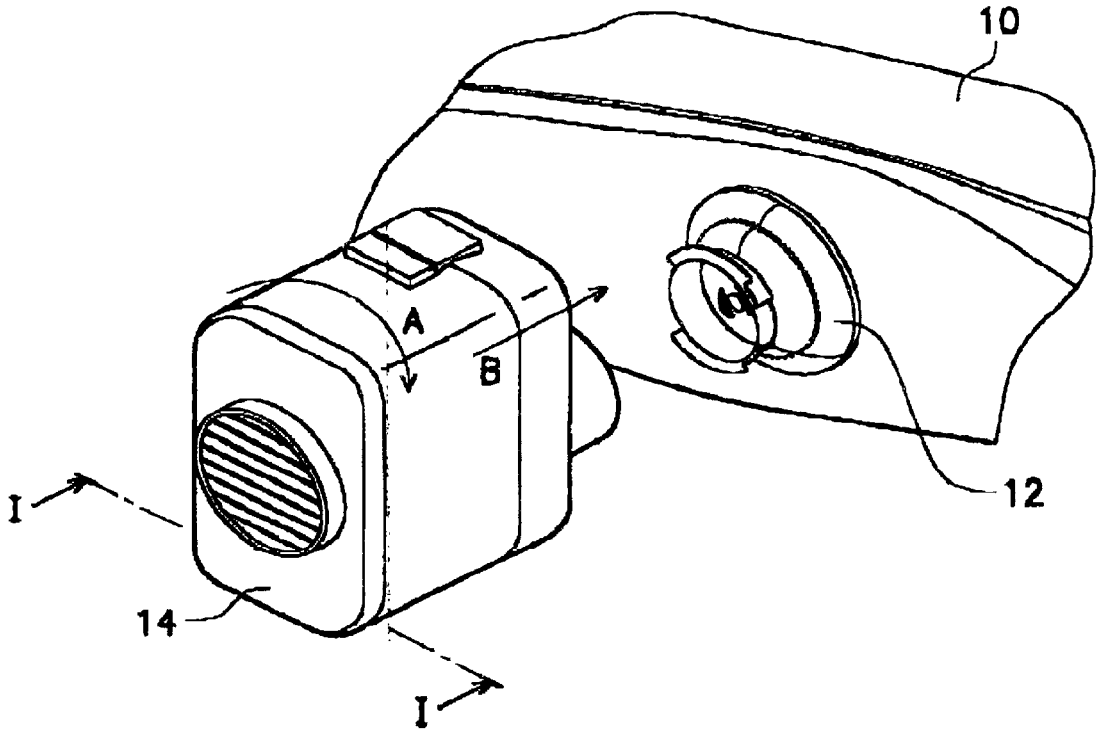
FIG. 1A (PRIOR ART)
FIG. 1A depicts a conventional airbed.
Figure 1B:
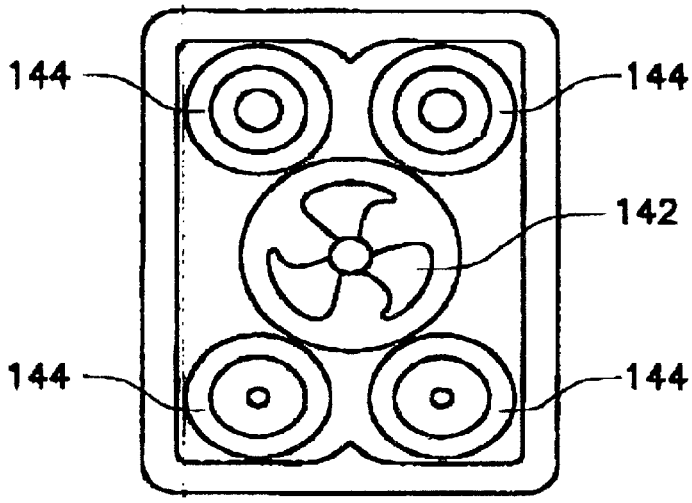
FIG. 1B (PRIOR ART)
FIG. 1B is a sectional view along line I—I in FIG. 1A.
Figure 2:
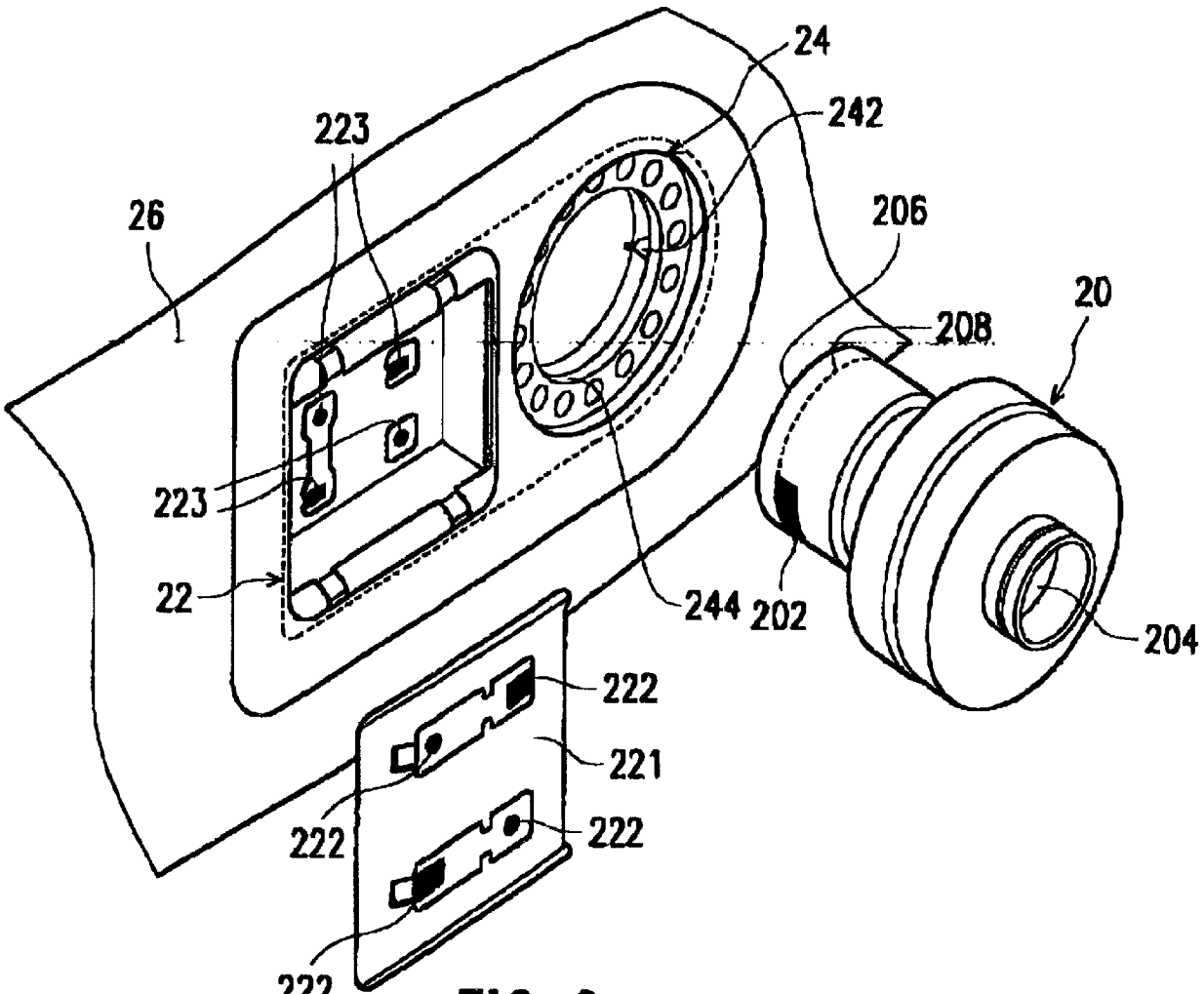
FIG. 2 locally depicts an airbed an accordance with a first embodiment of the present invention.

Referring to FIG. 2, an airbed 26 of a first embodiment of the present invention is provided with a detachable electric pump 20, a built-in battery case 22 and a built-in socket 24. The battery case 22 has a cover 221 on which electrodes 222 are provided. Also, on the bottom of the battery case 22 are provided electrodes 223 corresponding to the electrodes 222 of the cover 221. An O-ring 244 and an electrode 242 are provided on the inner wall of the socket 24, wherein the electrode 242 is electrically connected to the electrodes 222, 223 of the battery case 22. Furthermore, the electric pump 20 is substantially cylindrical and has an electrode 202 on its side surfaces, an air inlet 204 and an air outlet 206 on its ends and a check valve 208 inside. The check valve 208 of the electric pump allows air to flow in a single direction from the inlet 204 to the outlet 206.

Figure 3B:
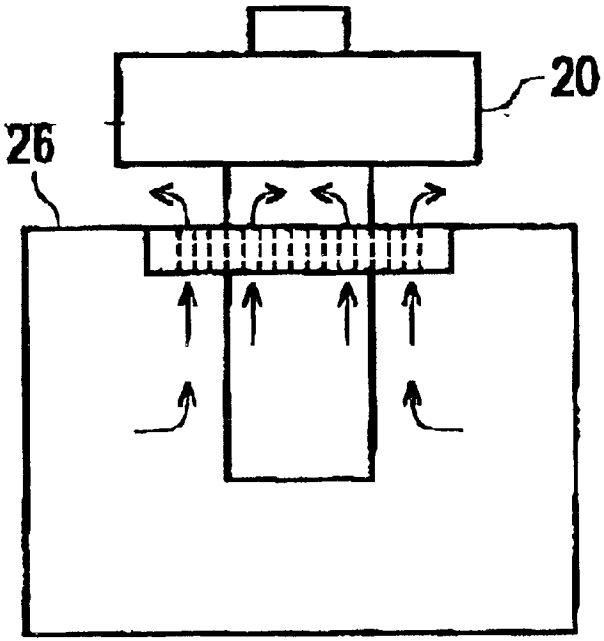
FIG. 3B shows the deflating operation of the airbed of the first embodiment.
Figure 3A:
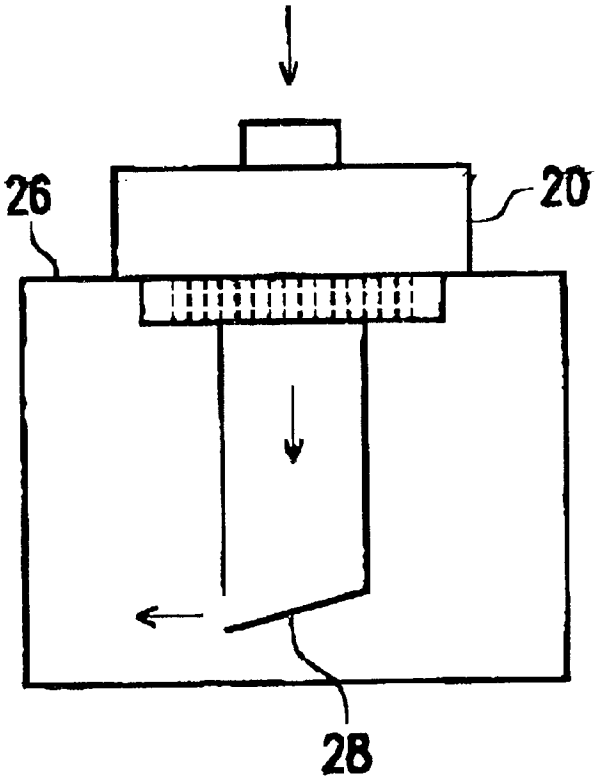
FIG. 3A shows the inflating operation of the airbed of the first embodiment.

In operation, batteries are loaded into the battery case 22. The electric pump 20 is fitted into the socket 24 and then rotated so that the electrode 202 of the electric pump 20 physically contacts the electrode 242 of the socket 24. Then, the electric pump 20 is actuated to pump outside air into the airbed 26 as shown in FIG. 3A. The O-ring 242 in the socket 24 prevents the airbed 26 from leaking. In deflating operation, the user detaches the electric pump 20 from the socket 24 to deflate the airbed 26, as shown in FIG. 3B.

It is understood that the O-ring can be provided on the side surfaces of the electric pump 20 instead of in the socket 24 to prevent the airbed from leaking.

Figure 4:
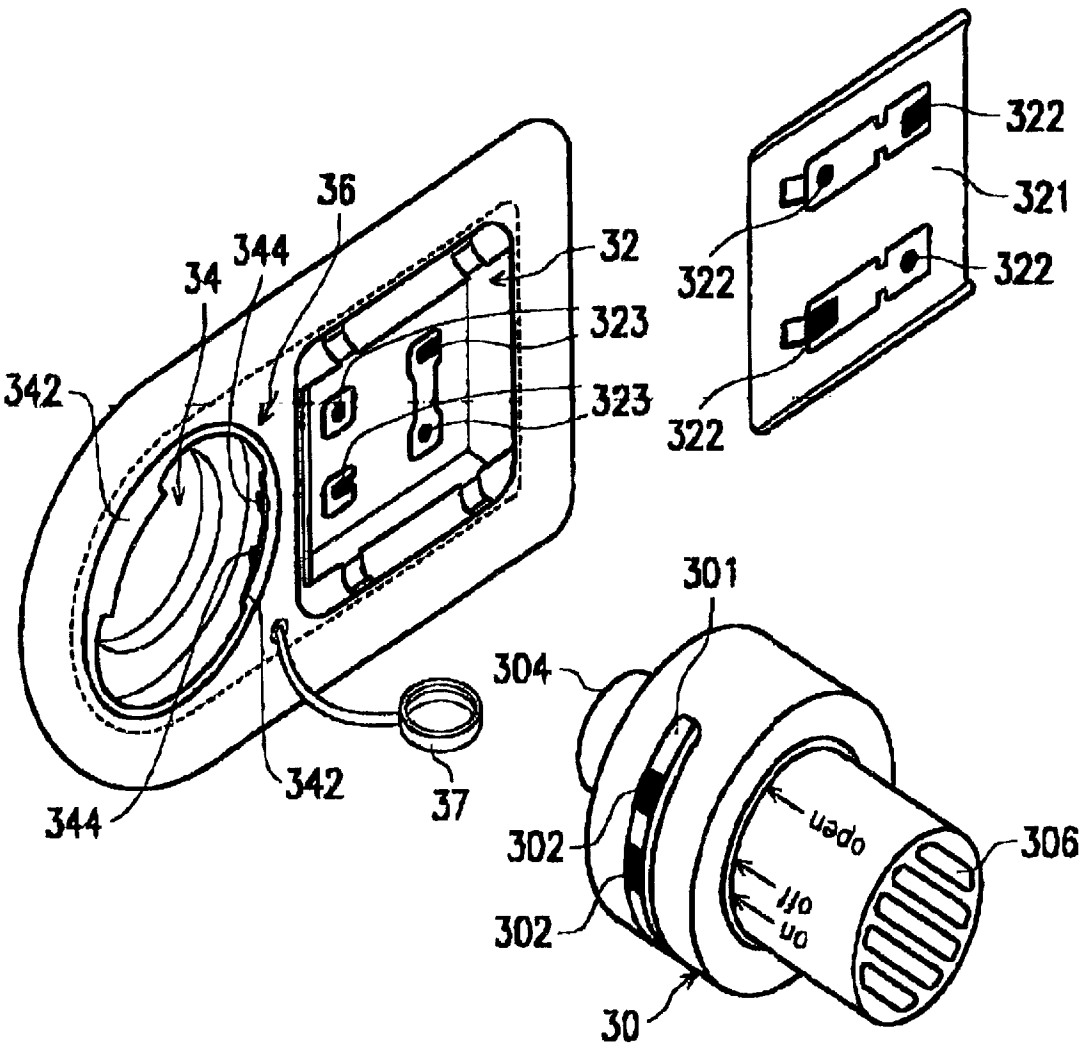
FIG. 4 locally depicts an airbed in accordance with a second embodiment of the present invention.
Figure 5:
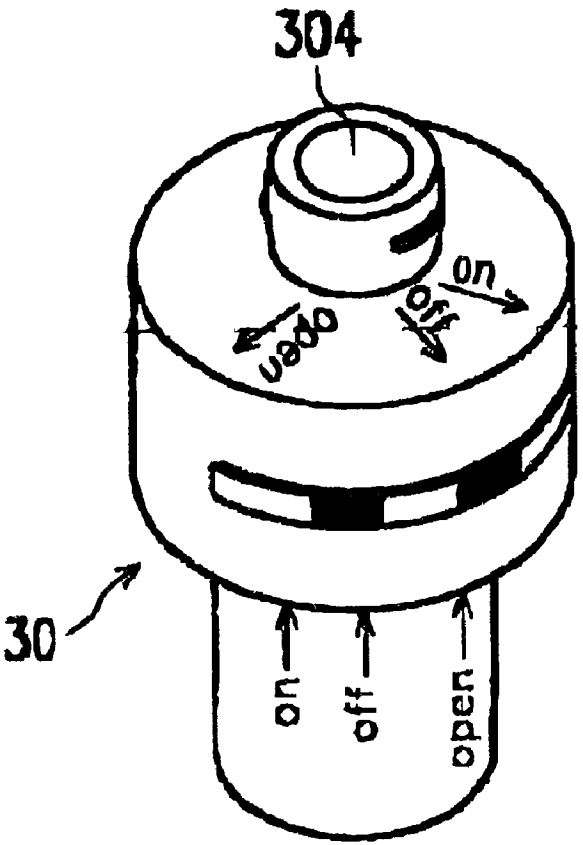
FIG. 5 is a perspective diagram of the electric pump of the second embodiment.

Referring to FIG. 4, an airbed of a second embodiment of the present invention is provided with a detachable electric pump 30, a cap 37 for the electric pump 30, a built-in battery case 32 and a built-in socket 34. The battery case 32 has a cover 321 on which electrodes 322 are provided. Also, on the bottom of the battery case 32 are provided electrodes 323 corresponding to the electrodes 322 of the cover 321. Furthermore, an arrow symbol 36 is marked on the airbed and besides the socket 34. Flanges 342 are formed at the rim of the socket 34, while electrodes 344 are provided on the inner wall of the socket 34 and are electrically connected to the electrodes 322, 323 of the battery case 32. Furthermore, the electric pump 30 is substantially cylindrical and has a flange 301 on its side surfaces, two electrodes 302 provided on the flange 301, an air inlet 304 and an air outlet 306 on its ends. Also referring to FIG. 5, symbols "on", "off" and "open" are marked on the side surfaces and the end of the electric pump 30.

Figure 6A:
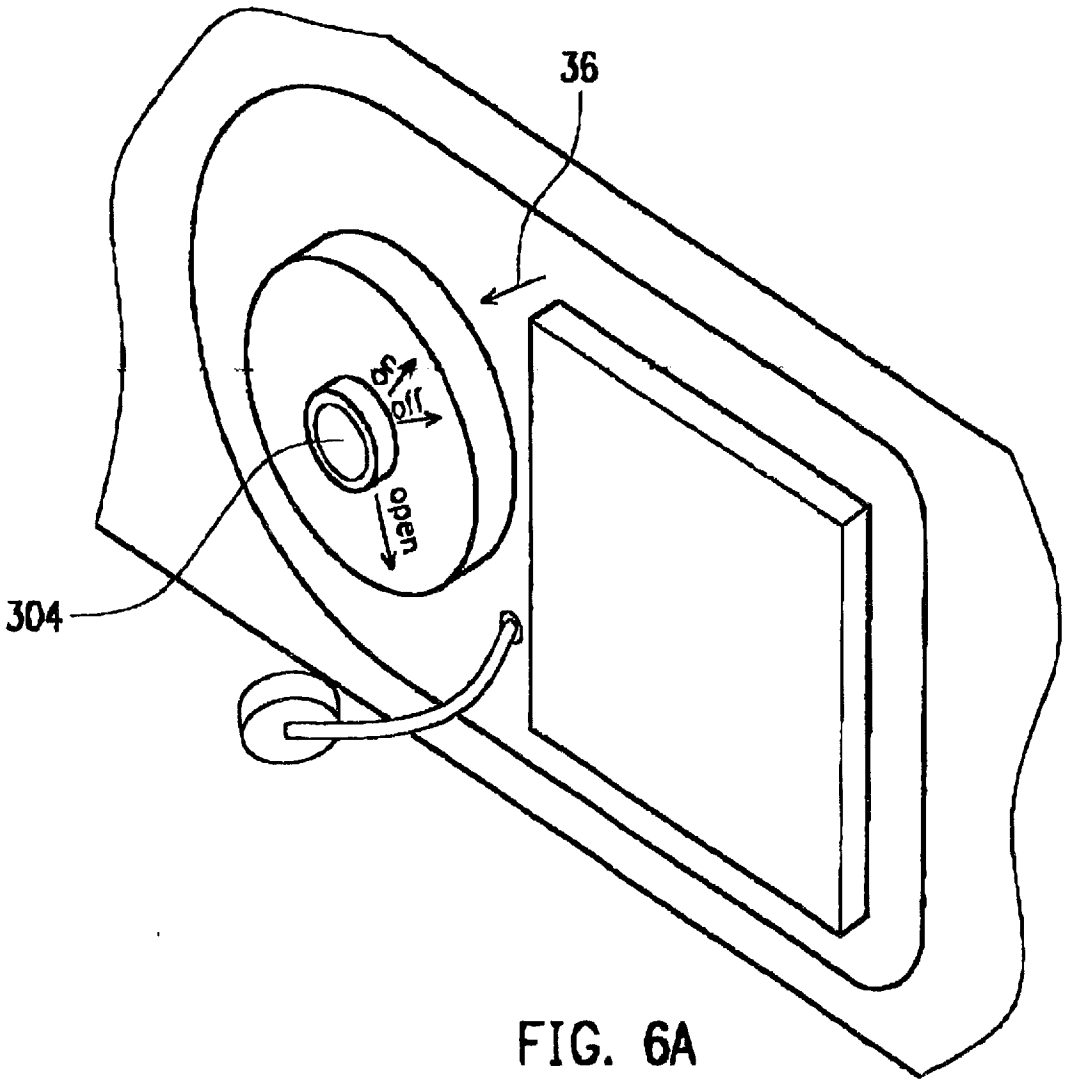
FIGS. 6A, 6B and 6C show the inflating operation of the airbed of the second embodiment.
Figure 6C:
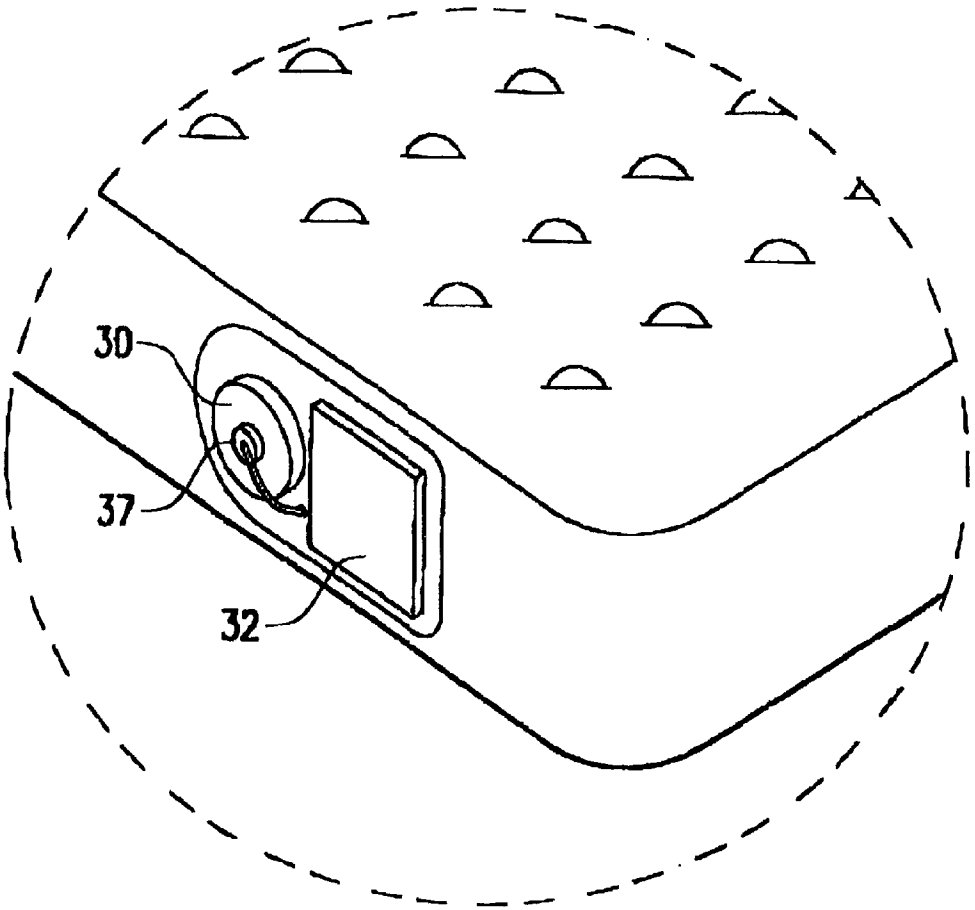
Figure 6B:
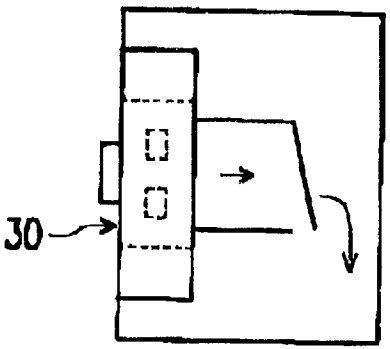

In operation, batteries are loaded into the battery case 32 to supply the electric pump 30 with the power. The electric pump 30 in this embodiment is used to inflate or deflate the airbed. In inflating operation, the electric pump 30 is fitted into the socket 34 with the air outlet 306 inside the airbed and the air inlet 304 outside the airbed. The electric pump 30 is rotated to change the positions of symbols "on", "off" and "open". When the arrow symbol 36 points at the symbol "on" as shown in FIG. 6A, the electrodes 302 of the electric pump 30 physically contact the electrodes 344 of the socket 34 to actuate the electric pump 30. Then, outside air is pumped into the airbed as shown in FIG. 6B. When the arrow symbol 36 points at the symbol "off", the electric pump 30 is stopped. When the arrow symbol 36 points at the symbol "open", the electric pump 30 is detachable from the socket 34. FIG. 6C depicts the airbed full of air, wherein the air outlet of the electric pump 30 is closed by the cap 37 to seal the airbed after the inflating operation.

Figure 7B:
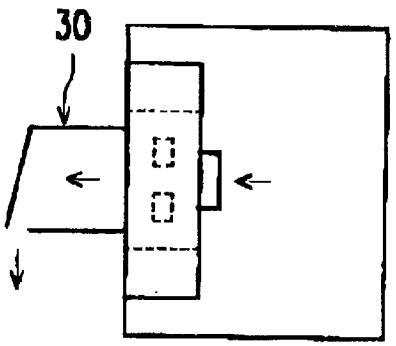
FIGS. 7A and 7B show the deflating operation of the airbed of the second embodiment.
Figure 7A:
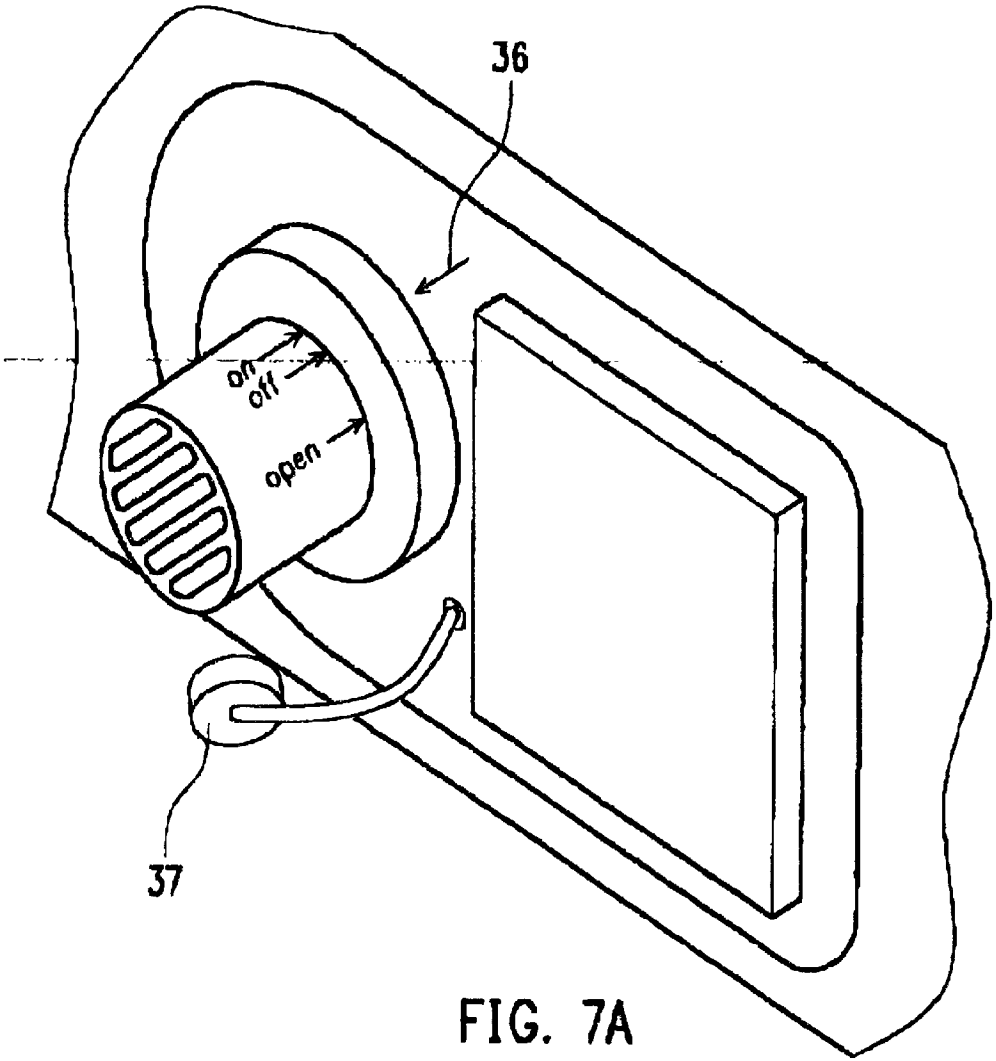

In the deflating operation, the electric pump 30 is fitted in reverse into the socket 34, with the air inlet 304 inside the airbed and the air outlet 306 outside the airbed. The electric pump 30 is rotated to change the positions of symbols "on", "off" and "open" on its side surfaces. When the arrow symbol 36 points at the symbol "on" as shown in FIG. 7A, the electrodes 302 of the electric pump 30 physically contact the electrodes 344 of the socket 34 to actuate the electric pump 30. Then, air inside the airbed is pumped out as shown in FIG. 7B. When the arrow symbol 36 points at the symbol "off", the electric pump 30 is stopped. When the arrow symbol 36 points at the symbol "open", the electric pump 30 is detachable from the socket 34.

In either of the inflating and deflating operations, the flanges 342 of the socket 34 are used for confining the flange 301 of the electric pump 30, thus preventing the electric pump 30 from separating with the socket 34 when the arrow symbol 36 points at the symbols "on" and "off". However, the flanges 342 are spaced apart at the rim of the socket 34 to avoid confining the flange 301 of the electric pump 30 when the arrow symbol 36 points at the symbol "open". Thus, the electric pump 30 is detachable from the socket 34 when the arrow symbol 36 points at the symbol "open".

Figure 8A:
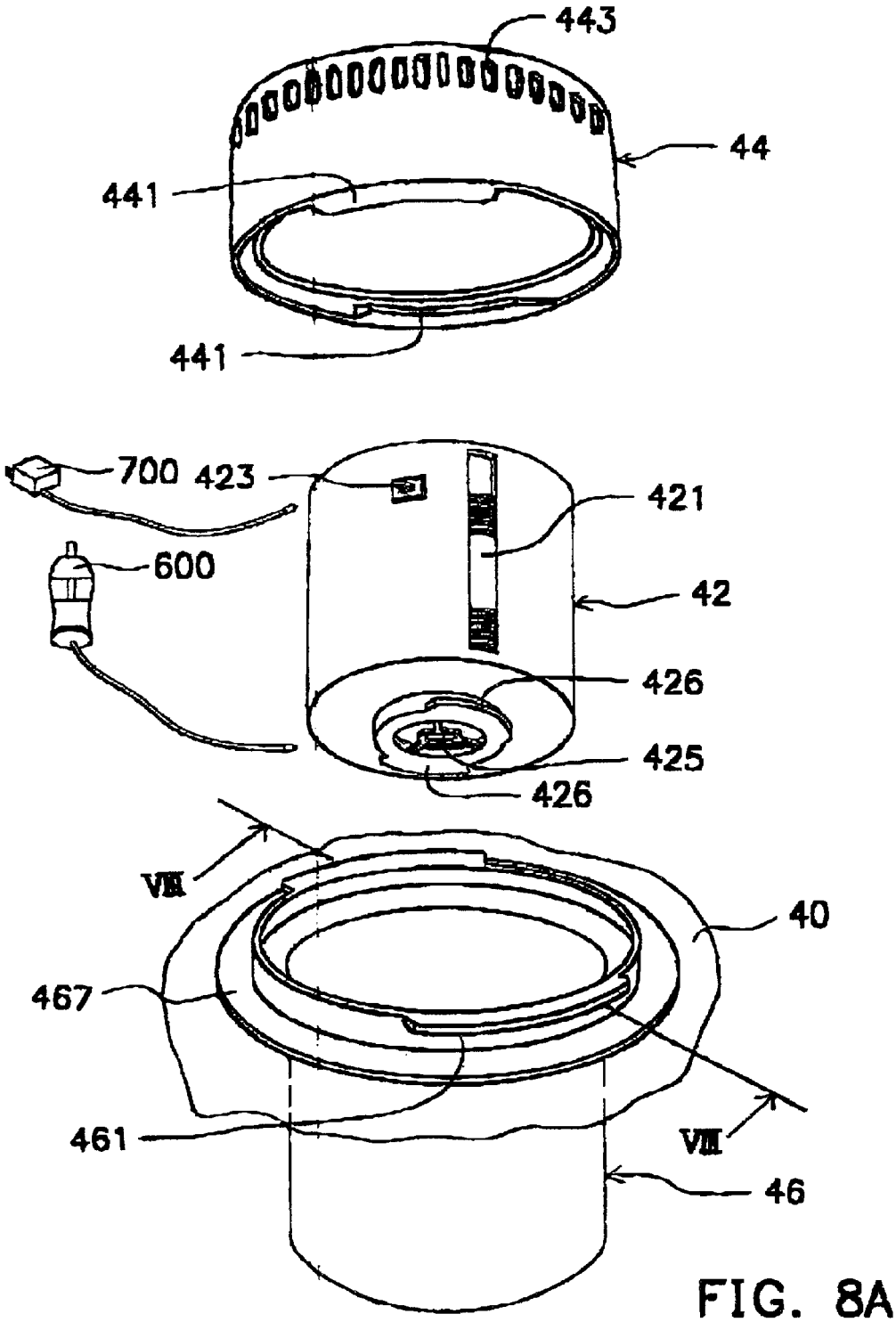
FIG. 8A is an exploded perspective diagram of a local portion of an airbed in accordance with a third embodiment of the present invention.
Figure 8B:
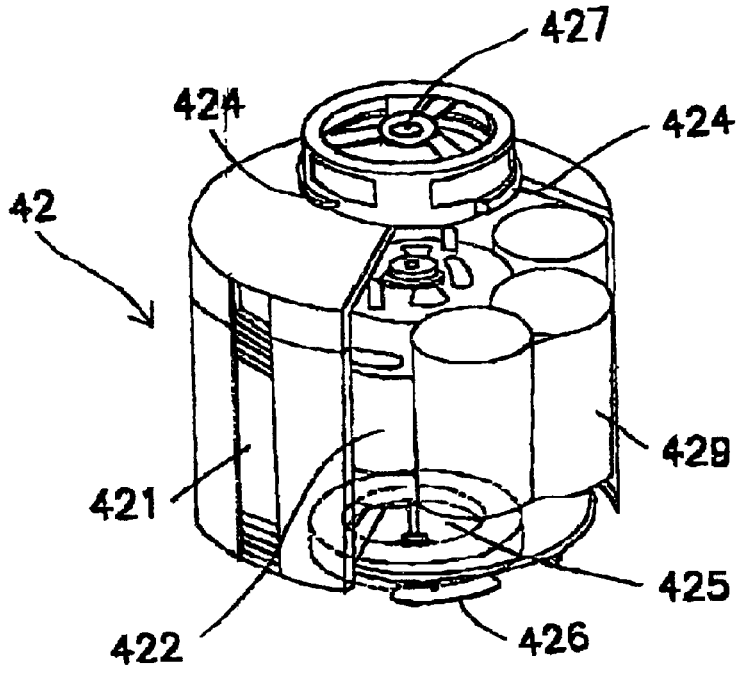
FIG. 8B is a perspective diagram of the electric pump of the airbed of the third embodiment.
Figure 8C:
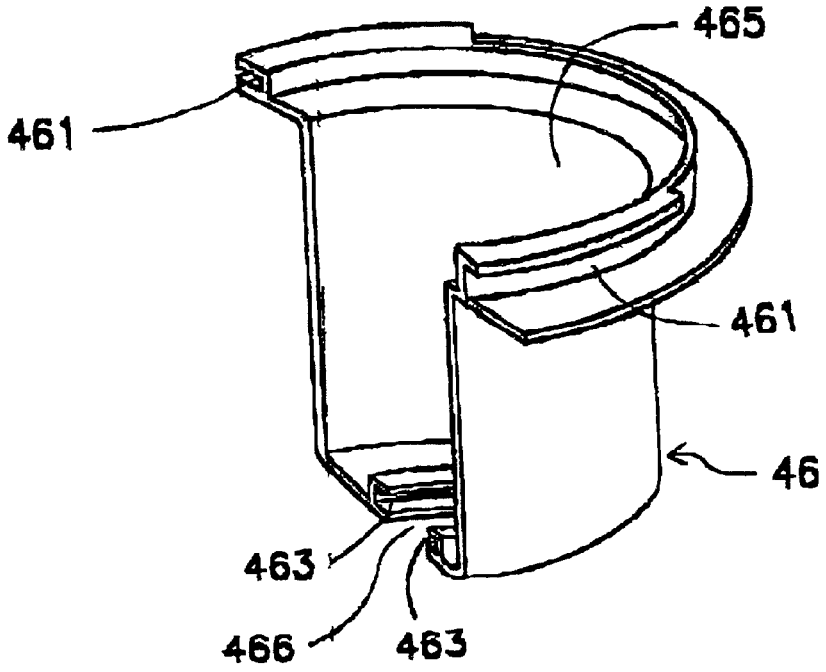
FIG. 8C is a sectional view of a socket of the airbed along line VIII—VIII in FIG. 8A.
Figure 8D:
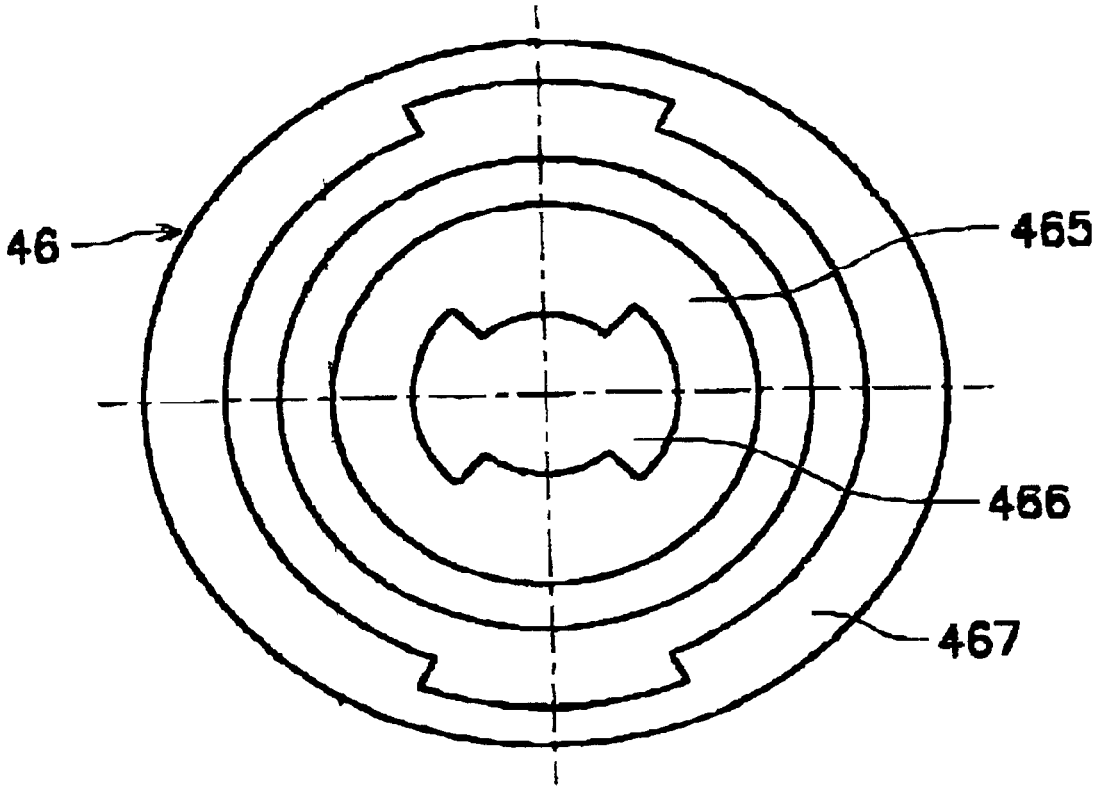
FIG. 8D is a top view of the socket shown in FIG. 8A.

Referring to FIG. 8A, an airbed of the third embodiment of the present invention is provided with a cover 44, an electric pump 42 and a built-in socket 46. The cover 44 is circular, with a plurality of recesses 443 provided on its side surfaces. Such an arrangement increases the friction on the side surfaces, facilitates the rotation of the cover 44. Furthermore, the cover 44 is closed at its top end and is opened at its bottom end. At the bottom end of the cover 44 is provided a pair of inward arcuate flanges 441. The arcuate flanges 441 extend to the bottom rim of the cover 44 to engage the socket 46 mounted on the body 40 of the airbed. The electric pump 42 is cylindrical. On the side surfaces of the electric pump is provided a switch 421 and a connector 423. Also referring to FIG. 8B, a plurality of rechargeable batteries 429 are provided in the electric pump 42 to supply the motor 422 with power. The connector 423 is used for connecting an external power (alternating current or direct current) to charge the batteries 429 or directly to actuate the electric pump 42. For example, the connector 523 is connected to a cigarette lighter (direct current) of a car via a cigarette plug 600. Alternatively, the connector 423 is connected to a alternating current power supply via a rectifier 700 which converts the alternating current into a direct current for the electric pump. Furthermore, at the ends of the electric pump 42 are provided a protruding air inlet 427 and a protruding air outlet 425. Outward flanges 424, 426 are respectively provided at the air inlet 427 and air outlet 425. The socket 46 is a cylindrical housing, while an annular flange 467 is provided on the side surfaces of the socket 46 to define an upper portion and a lower portion of the socket 46. The annular flange 467 is welded together with the body 40 of the airbed so that the lower portion of the socket 46 is buried in the airbed. Referring to FIG. 8C, the socket 46 has a large hole 465 at its top end and a small hole at its bottom end. The large hole 465 at the top end is circular. The small hole 466 at the bottom end is shown in FIG. 8D, the shape of which matches those of the air inlet 427 and air outlet 425 of the electric pump 42. Furthermore, the socket 46 has grooves 461 formed on the outer surface of the upper portion and other grooves 463 formed at the inner circumferences of the hole 466 at the bottom end.

Figure 8E:
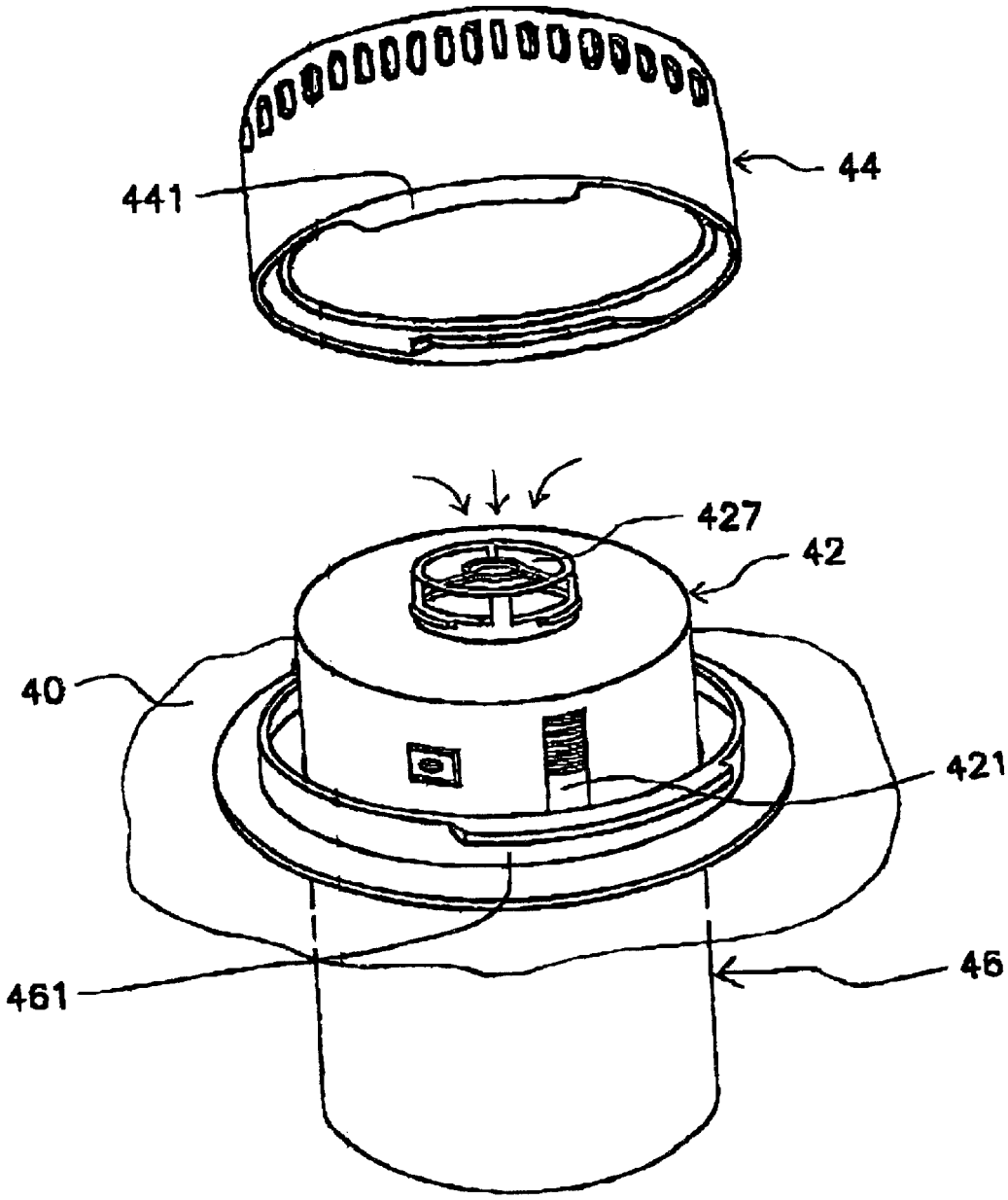
FIG. 8E depicts the electric pump and the socket assembled together in accordance with the third embodiment of the present invention.
Figure 8F:
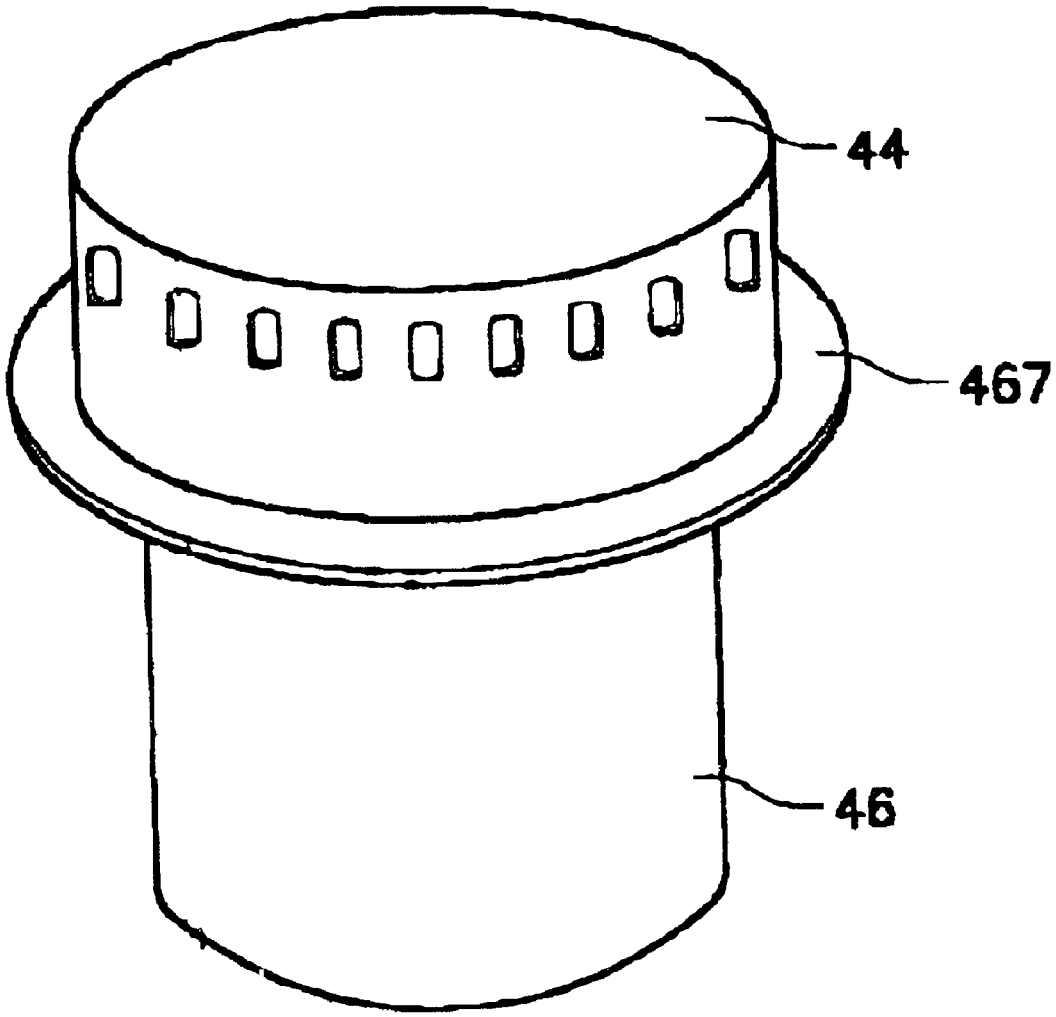
FIG. 8F depicts the cover, the electric pump and the socket assembled together in accordance with the third embodiment of the present invention.

In the inflating operation, the electric pump 42 is put in the socket 46, with the air outlet 425 of the electric pump 42 aligning with the bottom hole 466 of the socket 46. Then, the electric pump 42 is rotated so that the flanges 426 of the electric pump 42 enter the grooves 463 at the bottom end of the socket 46. Thus, the electric pump 42 and the socket 46 are firmly connected together, as shown in FIG. 8E. The user pushes the switch 421 of the electric pump 42 to pump outside air into the body 40 of the airbed. The air flows from the air inlet 427, through the air outlet 425 and bottom hole 466, to the inside of the airbed.

If the airbed is used on the water, then the cover 44 is necessarily assembled together with the socket 46. The user rotates the cover 44 so that the inner flanges 441 enter the grooves 461 of the socket 46. Thus, the cover 44 and the socket 46 are firmly connected together. The cover 44 protects the electric pump 42 from water.

In the deflating operation, the electric pump 42 is fitted in reverse into the socket 46, with the air inlet 427 of the electric pump 42 aligning with the bottom hole 466 of the socket 46. Then, the electric pump 42 pumps air inside the airbed out.

Figure 9A:
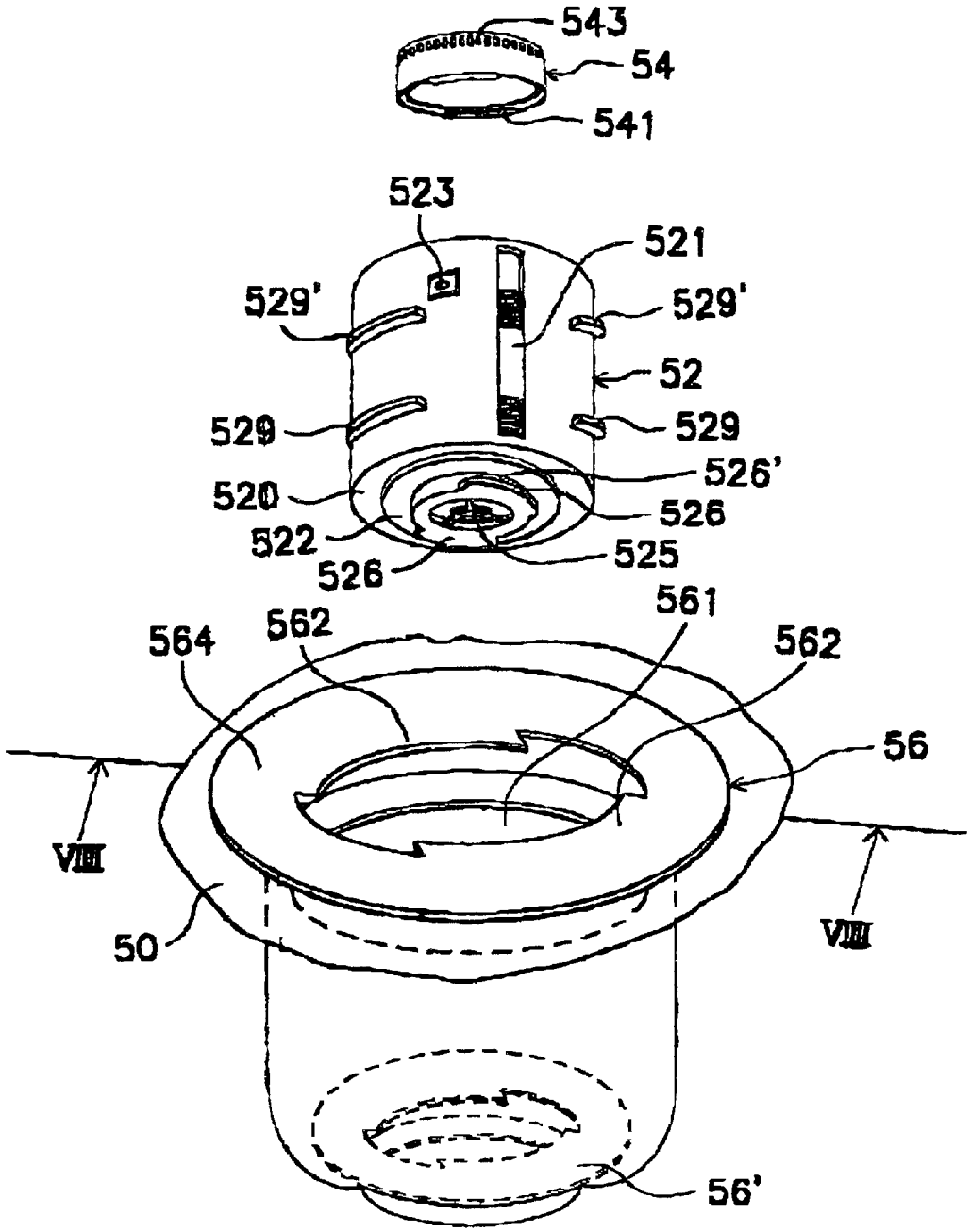
FIG. 9A is an exploded perspective diagram of a local portion of an airbed in accordance with a fourth embodiment of the present invention.
Figure 9B:
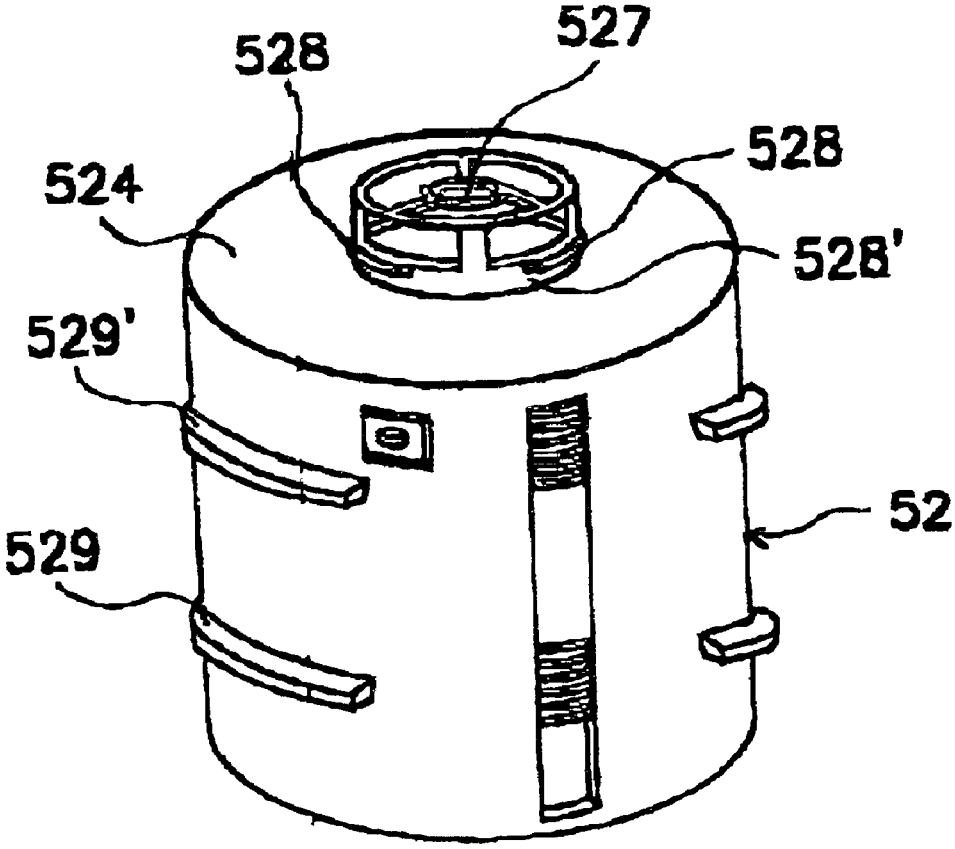
FIG. 9B is a perspective diagram of the electric pump of the airbed of the fourth embodiment.
Figure 9C:
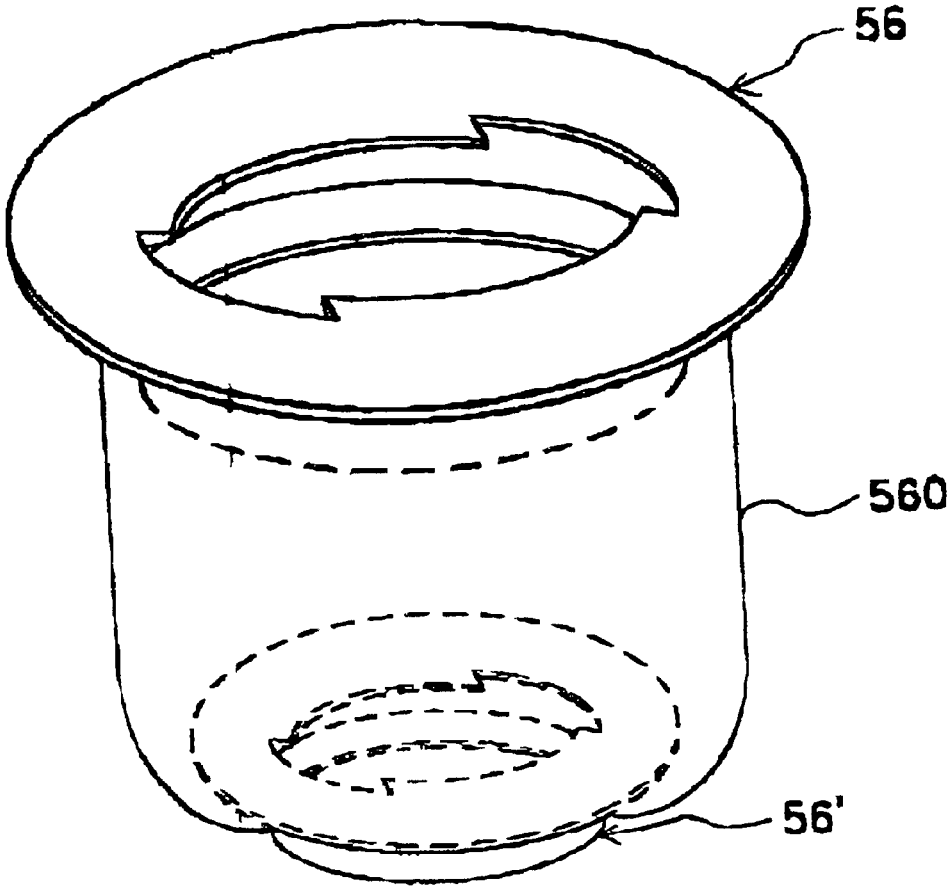
FIG. 9C depicts a set of sockets of the fourth embodiment.
Figure 9D:
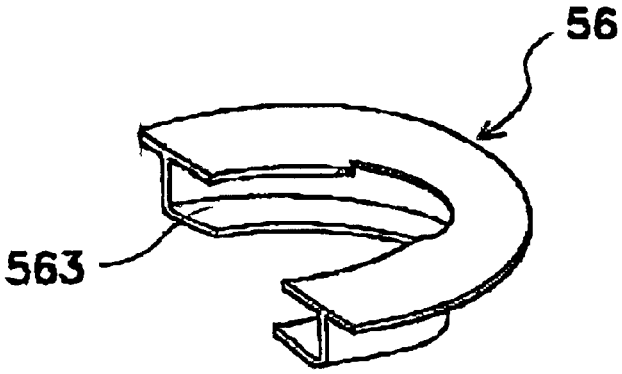
FIG. 9D is a sectional view of a socket of the airbed along line VIIII—VIIII in FIG. 9A.

Referring to FIG. 9A, an airbed of the fourth embodiment of the present invention is provided with a cover 54, an electric pump 52 and a set of sockets 56, 56' built in the body of the airbed. The cover 54 is circular, with a plurality of recesses 543 provided on its side surfaces. Such an arrangement increases the friction on the side surfaces, facilitates the user to rotate the cover 54. Furthermore, the cover 54 is closed as its top end and is opened at its bottom end. At the bottom end of the cover 54 is provided a pair of inward arcuate flanges 541. The arcuate flanges 541 extend to the rim of the bottom end of the cover 54 for engaging the socket 56. The electric pump 52 is cylindrical. On the side surfaces of the electric pump 52 are provided a switch 521, an connector 523 and circumferential flanges 529, 529'. Furthermore, a plurality of rechargeable batteries (not shown) are provided in the electric pump 52 to supply the power. The connector 523 is used for connecting an external power to charge the batteries or directly to actuate the electric pump 52. Referring to both FIGS. 9A and 9B, at the ends 524, 520 of the electric pump 52 are provided a protruding air inlet 527 and a protruding air outlet 525. A pair of outward flanges 528 are provided at the air inlet 527, with grooves 528' formed between the flanges 528 and the end 524. Another pair of outward flanges 526 are provided at the air outlet 525 to form grooves 526' between the flanges 526 and the end 520. Referring to FIG. 9C, the set of sockets include a top socket 56 and a bottom socket 56' connected by a flexible sleeve 560. The top socket 56 is welded together with the body 50 of the airbed. The top and bottom sockets 56, 56' have the same structure and therefore only the top socket 56 is now introduced. The top socket 56 has a top surface 564 with a through hole 561 provided on the top surface 564. Furthermore, the top socket 56 has a pair of inward flanges 562 protruding from the top surface 564 toward the through hole 561. Referring to FIG. 9D, an annular groove 563 is formed in the socket 56.

Figure 9E:
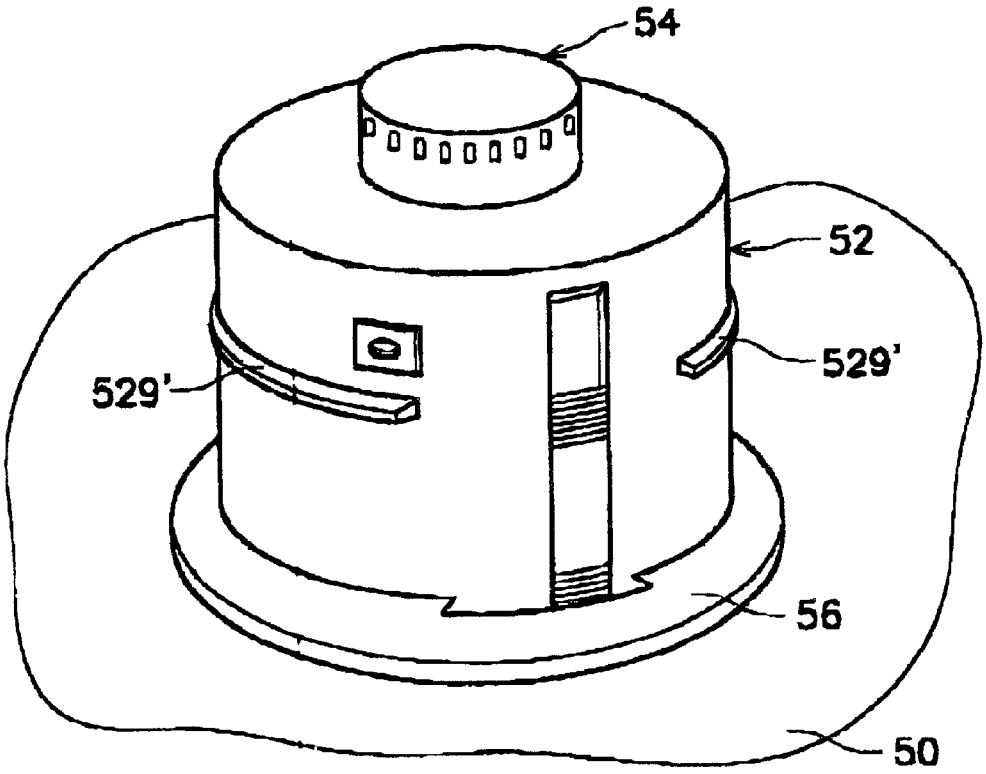
FIG. 9E depicts the cover, the electric pump and the socket assembled together in accordance with the fourth embodiment of the present invention.

In the inflating operation, the electric pump 52 is inserted into the set of sockets 56, 56' on the airbed 50. The protruding air outlet 525 of the electric pump 52 is fitted into the bottom socket 56'. The rubber pad 522 eliminates any gaps between the bottom sockets 56' and the electric pump 52 through which the airbed possibly leaks. The circumferential flanges 529 of the electric pump 52 enter the groove 563 of the socket 56. Then, the electric pump 52 is rotated so that the flanges 529 of the electric pump 52 are confined in the grooves 563 by the flanges 562 of the top socket 56. Then, the user pushes the switch 521 on the electric pump 52 to pump the airbed. After the airbed is filled with air, the user assembles the cover 54 and the electric pump 52 as shown in FIG. 9E, with the flanges 541 of the cover 54 received in the grooves 528' of the electric pump 52. The cover 54 prevents the airbed from leaking though the air inlet 527.

In the deflating operation, the electric pump 52 is reversely disposed with the air inlet 527 connected to the bottom socket 56'. Also, the flanges 528 of the electric pump 52 are confined in the grooves 563 by the flanges 562 of the top socket 56. Then, the user pushes the switch 521 on the electric pump 52 to pump air in the airbed out. It is noted that the electric pump 52 is not protected from water. Nevertheless, the electric pump 52 can be modified to be waterproof, introduced in the following fifth embodiment.

Figure 10A:
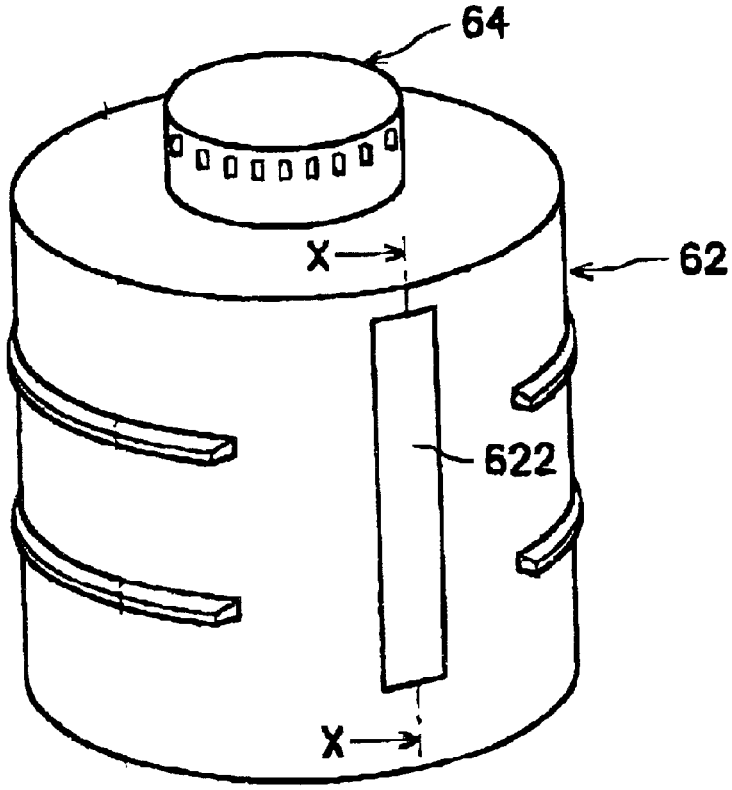
FIG. 10A is a perspective diagram of a local portion of an airbed in accordance with a fifth embodiment of the present invention.
Figure 10B:
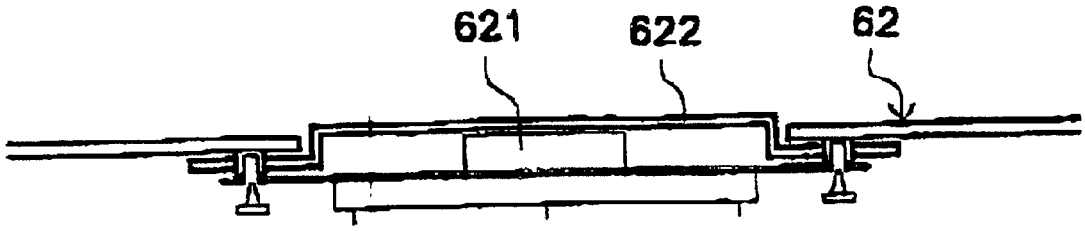
FIG. 10B is a sectional view of the electric pump along line X—X of FIG. 10A.

Refer to FIGS. 10A and 10B. Reference numeral 64 is a cover and reference numeral 62 is a waterproof electric pump. The waterproof electric pump 62 of the fifth embodiment is similar with the electric pump 52 of the fourth embodiment except that (1) the waterproof electric pump 62 has no connector on its side surfaces; (2) the switch 621 of the waterproof electric pump 62 is covered by a waterproof rubber strip 622. The waterproof rubber strip 622 is so thin that the user can still push the switch 621 from outside the rubber strip 622 to actuate the electric pump 62.

Figure 11:
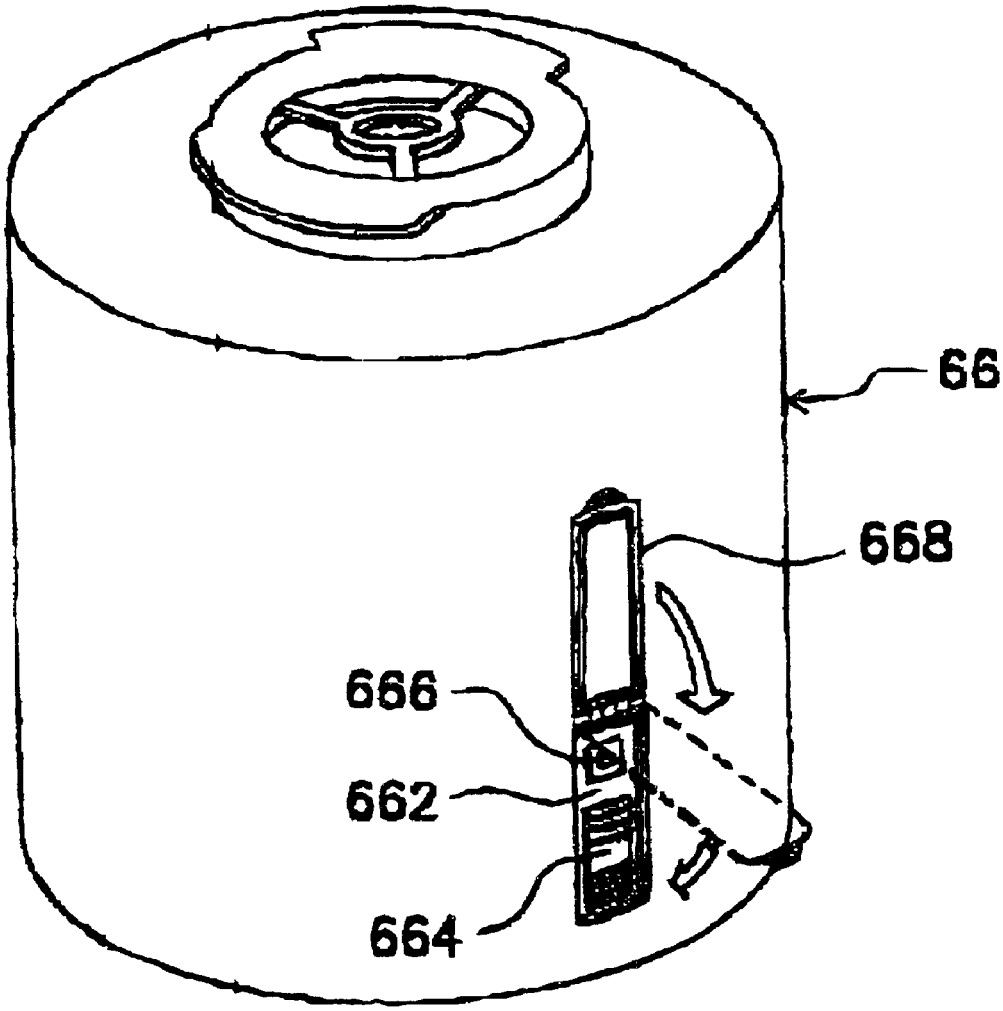
FIG. 11 is a perspective diagram of an electric pump of an airbed in accordance with a sixth embodiment of the present invention.

FIG. 11 depicts another waterproof electric pump 66 in accordance with a sixth embodiment of the present invention, wherein a recess 662 is provided on the side surfaces of the electric pump 66. A switch 664 and a connector 666 are provided in the recess 662, while a lid 668 is rotatably mounted on the side surfaces of the electric pump 66 to protect the switch 664 and the connector 666 from water.

Figure 12A:
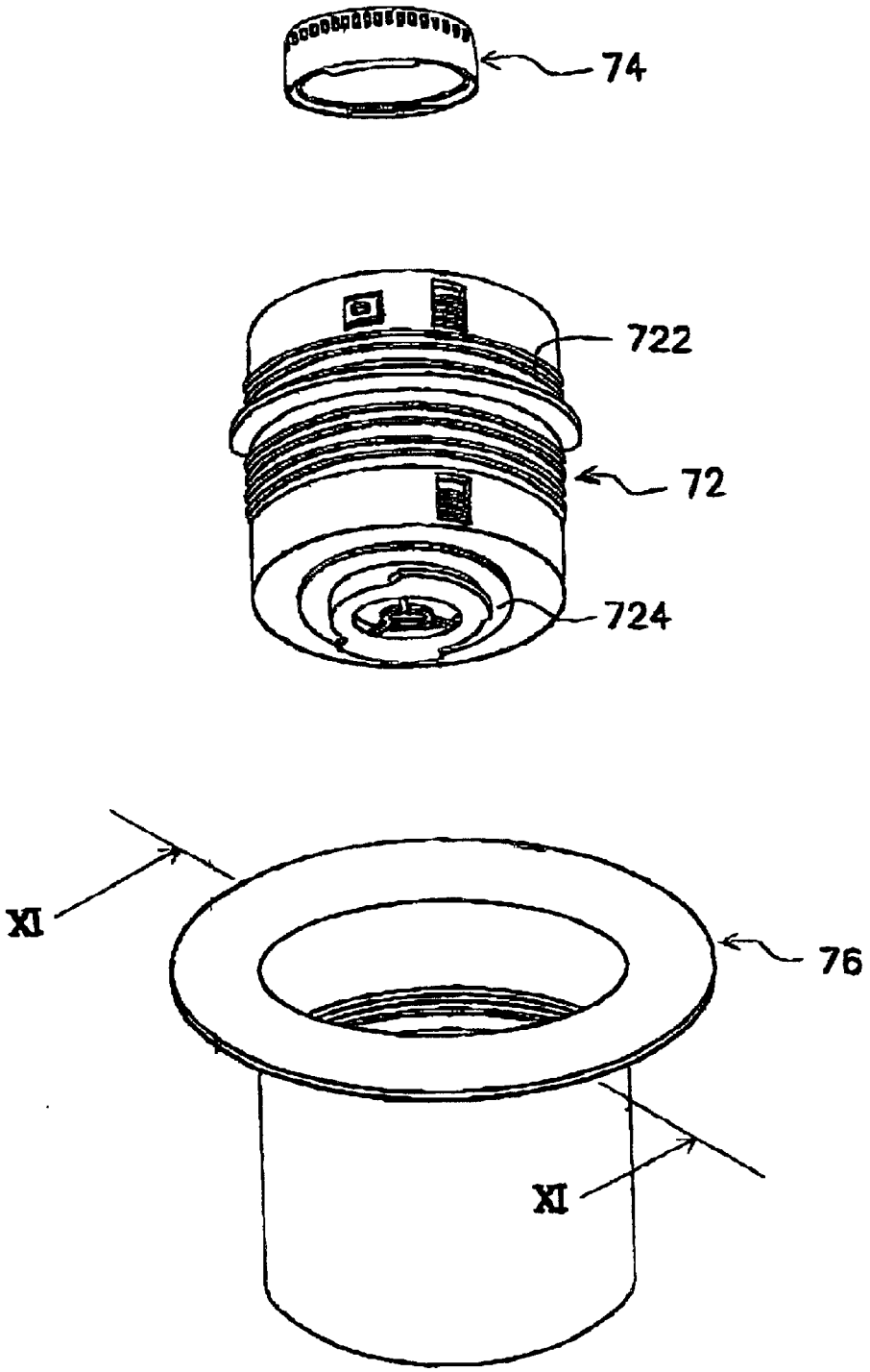
FIG. 12A is a perspective diagram of a cover, electric pump and socket of an airbed in accordance with a seventh embodiment of the present invention.
Figure 12B:
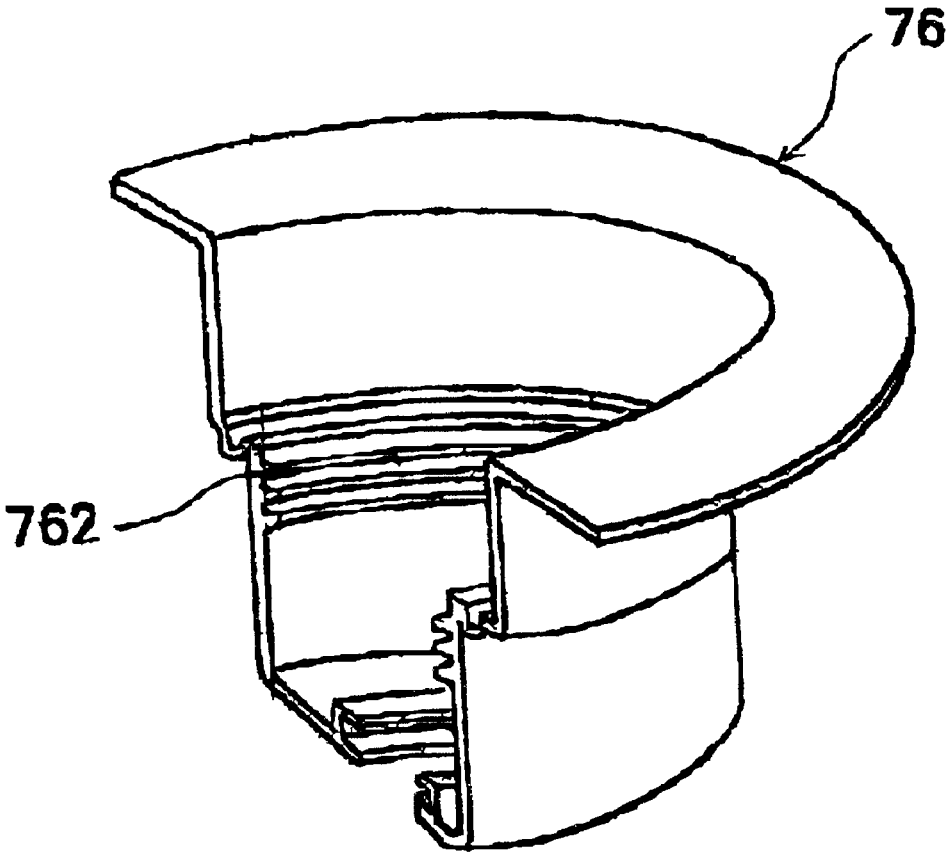
FIG. 12B is a sectional view of the socket along line XI—XI of FIG. 12A.

Referring to FIGS. 12A and 12B, an airbed of a seventh embodiment of the invention is provided with a socket 76, an electric pump 72 and a cover 74. The socket 76 has threads 762 on its inner surfaces, while the electric pump 72 has threads 722 on its outer surfaces so that the electric pump 72 and the socket 76 can be screwed together. Furthermore, the electric pump 72 has rubber pads 724 on both ends. The arrangement of rubber pads 724 eliminates any gaps between the socket 76 and the electric pump 72 through which the airbed possibly leaks, when the electric pump 72 and the socket 76 are screwed together. Furthermore, it is noted that the cover 74 is mounted on the electric pump 72 rather than the socket 76 to prevent an air leakage.

Figure 13A:
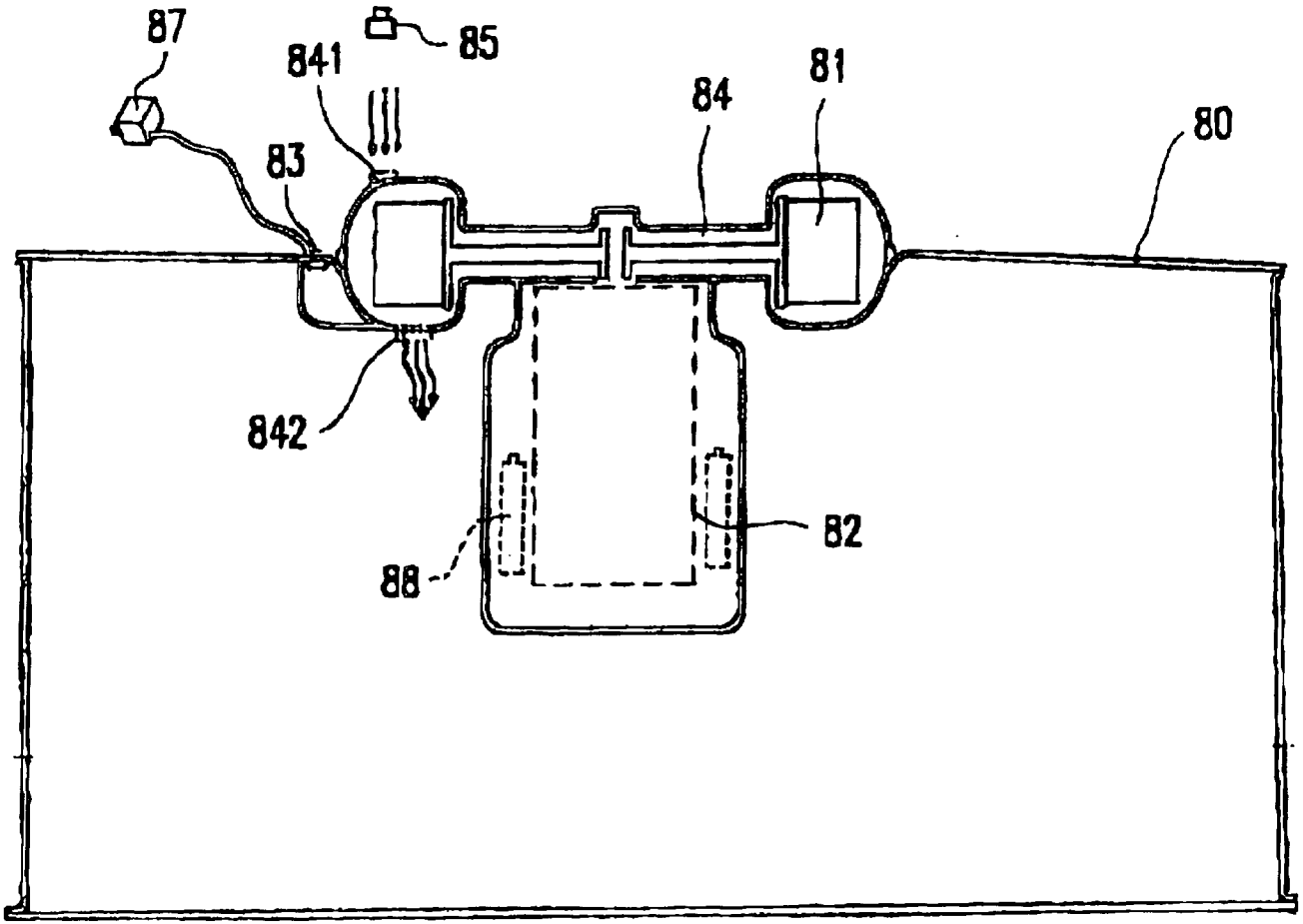
FIG. 13A is a schematic diagram of an airbed in an inflating operation in accordance with an eighth embodiment of the present invention.
Figure 13B:
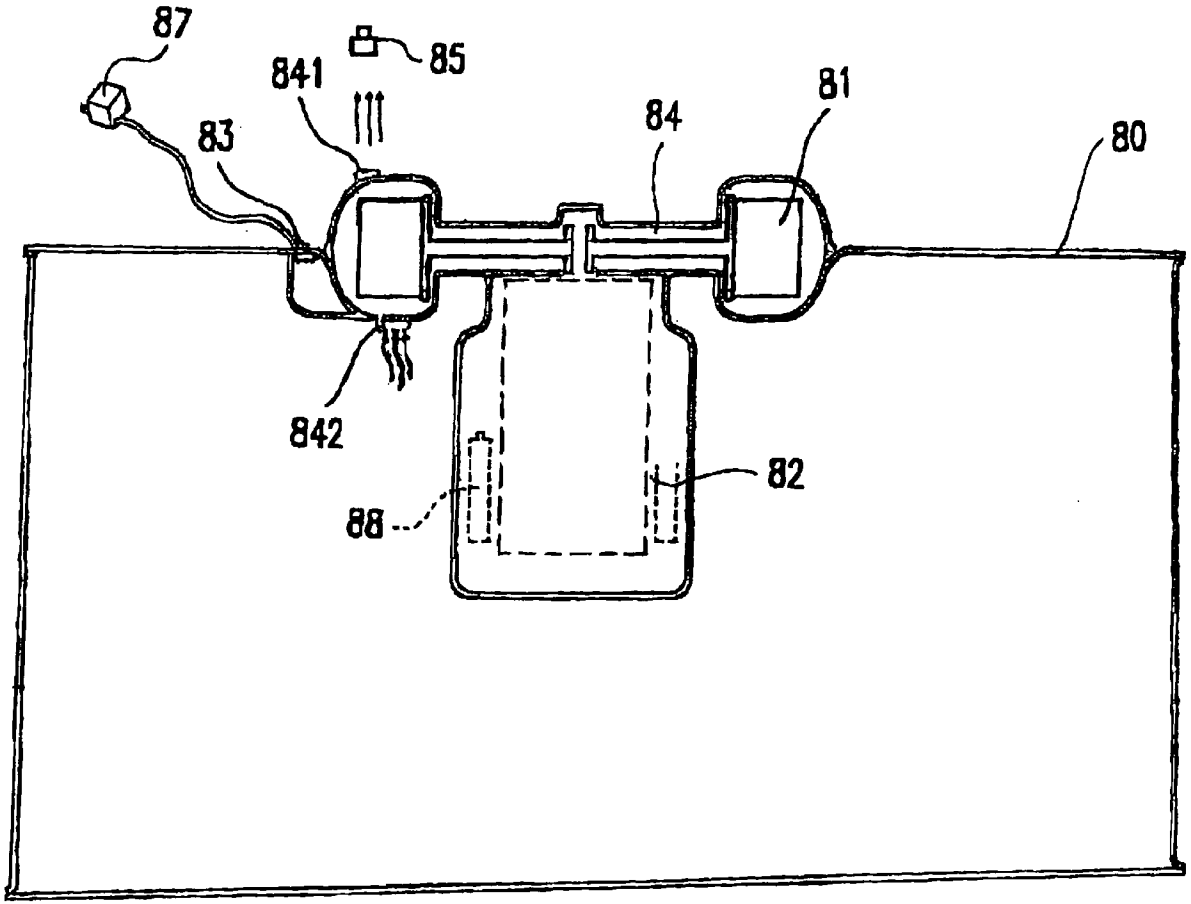
FIG. 13B is a schematic diagram of the airbed in a deflating operation in accordance with the eighth embodiment of the present invention.

Referring to FIG. 13A, an airbed 80 of an eighth embodiment of the invention is provided a cover 85, a chamber 84, a fan 81 received in the chamber 84, a motor 82 for rotating the fan 81, a plurality of rechargeable batteries 88 for supplying the motor 82 with power, and a switch 83 for actuating the motor 82. The motor 82 is also connected to an external power to charge the batteries 88 or directly to actuate the motor 82. The external power supplies an alternating current via a rectifier 87 or supplies a direct current via a cigarette plug (not shown). The chamber 84 has a nozzle 841 communicating the chamber 84 and the outside of the airbed 80, and a hole communicating the chamber 84 and the inside of the airbed 80. In the inflating operation, the user pushes the switch 83 to actuate the motor 82 and fan 81. Then, outside air is pumped into the airbed 80 through the nozzle 841 and the hole 842. After the airbed 80 is filled with air, the user closes the nozzle with the cover 85 to prevent the airbed from leaking. Referring to FIG. 13B, in the deflating operation, the user takes away the cover 85 and pushes the switch 83 to rotate the motor 82 and fan 81 in reverse. Then, air inside the airbed 60 is pumped out.

Figure 14:
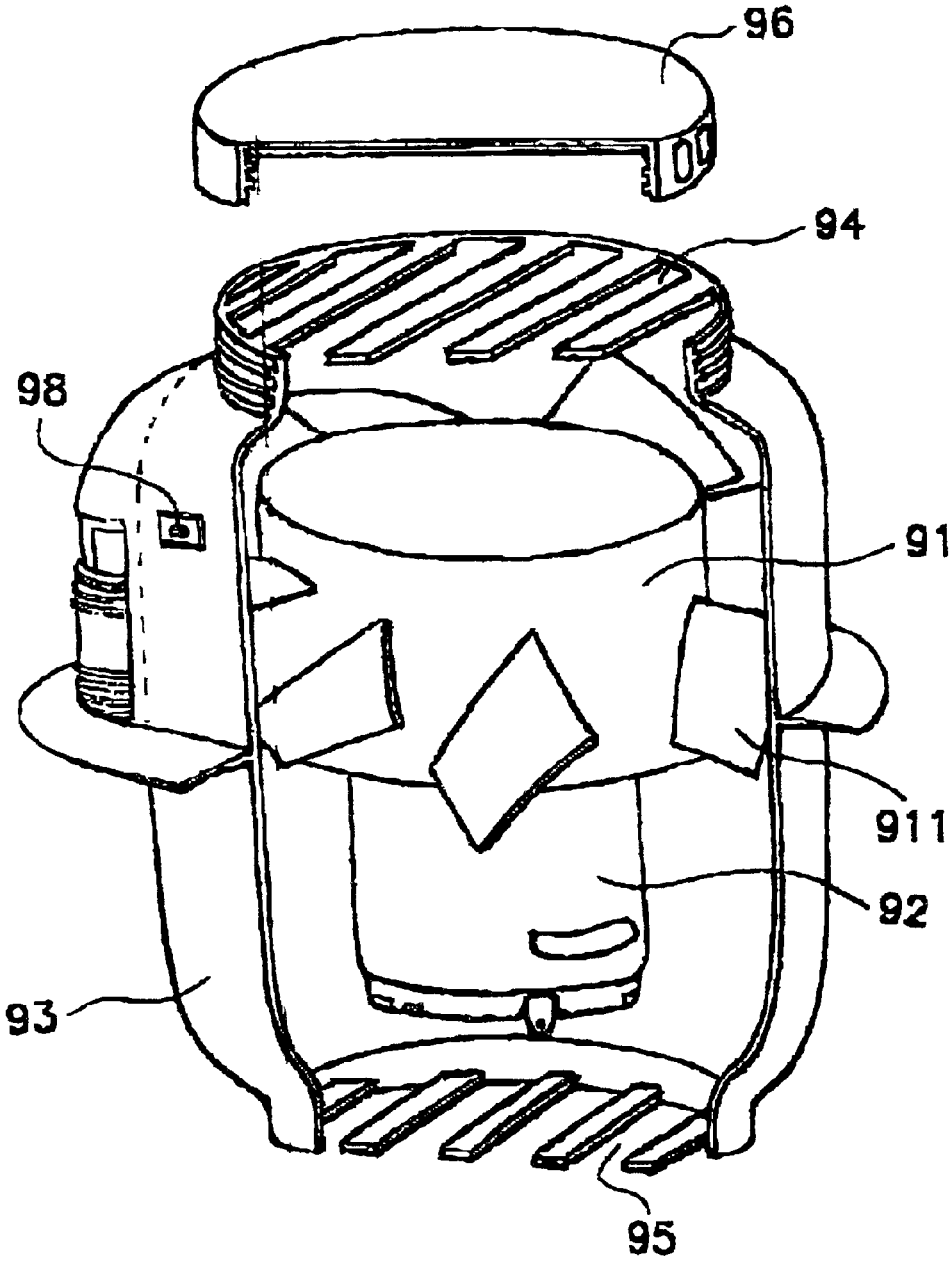
FIG. 14 is a perspective diagram of an electric pump of an airbed in accordance with a ninth embodiment of the present invention.

In the eighth embodiment, the fan 81 is received in a chamber 84 and is driven by an outside motor 82. However, it is understood that the fan and motor can be housed together to operate. Referring to FIG. 14, in a ninth embodiment of the present invention, a motor 92 and a fan 91 with helical blades 911 are assembled and are received in a housing 93. The motor 92 is actuated by rechargeable batteries (not shown) or by an external power (not shown) via a connector 98, wherein the external power supplies an alternating current or a direct current. The housing 93 is mounted on the airbed (not shown) and has a first hole 94 communicating the outside of the airbed and a second hole communicating the inside. In the inflating operation, the fan 91 and motor 92 pump outside air into the airbed through the holes 94, 95. When the airbed is filled with air, the cover 96 is screwed to the housing 93 to prevent an air leakage. In the deflating operation, the cover 96 is taken away. The fan 91 is rotated by the motor 92 in reverse to pump air inside the airbed out.

Figure 15:
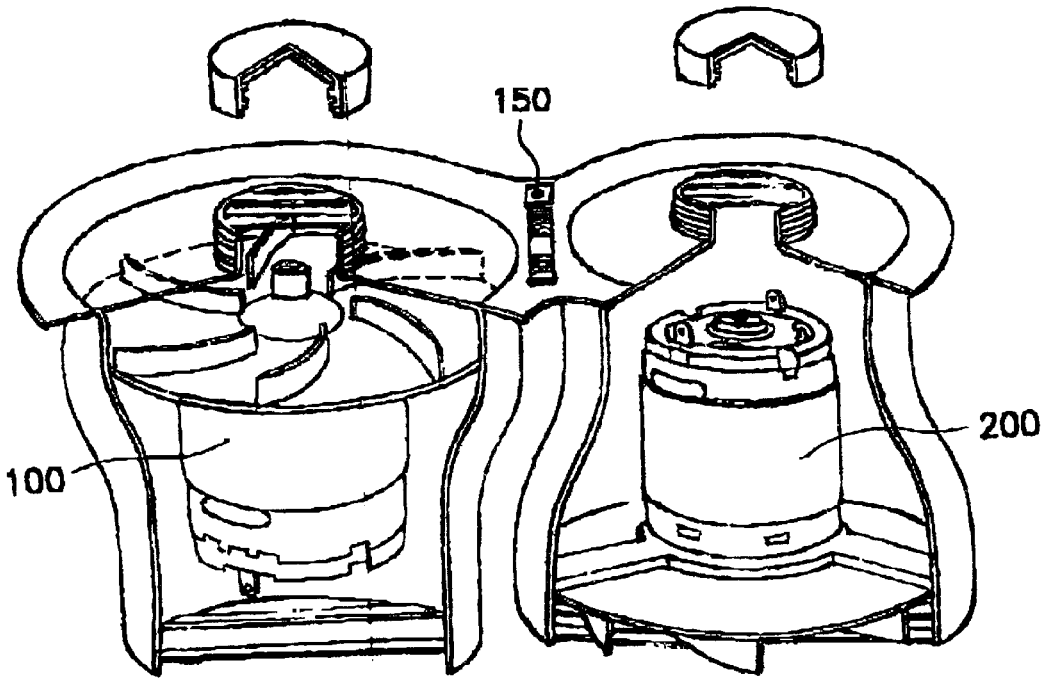
FIG. 15 is a perspective diagram of an electric pump of an airbed in accordance with a tenth embodiment of the present invention.

Referring to FIG. 15, in a tenth embodiment of the present invention, a first fan and motor 100 and a second fan and motor 200 are housed in different chambers. The first and second fans and motors 100, 200 are permanently or detachably connected to the airbed (not shown). Furthermore, the motors 100 and 200 are actuated by rechargeable batteries (not shown) or by an external power (not shown) via a connector 150. In the inflating operation, the first fan and motor 100 is actuated to pump the airbed (not shown) while the second fan and motor 200 is at rest. In the deflating operation, the first fan and motor 100 is at rest while the second fan and motor 200 is actuated to pump air inside the airbed out.

In conclusion, the invention provides various ways to pump an airbed or other inflatable products.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. An inflatable product including:

an inflatable body;

a socket built in the inflatable body;

an electric pump, including a pump body and an air outlet, connected to the socket to pump the inflatable body, wherein the pump body is wholly or partially located in the socket;

at least one battery disposed in the electric pump; and a connector provided on the electric pump for connecting an external power, whereby the electric pump is actuated by the at least one battery or the external power.

2. An inflatable product as claimed in claim 1, wherein the at least one battery is rechargeable and is electrically connected to the connector so that the at least one battery can be charged by the external power via the connector.

3. An inflatable product as claimed in claim 1, wherein the external power supplies an alternating current.

4. An inflatable product as claimed in claim 1, wherein the external power supplies a direct current.

5. An inflatable product as claimed in claim 1, further including a cover assembled with the socket to entirely cover the electric pump, thereby protecting the electric pump from water.

6. An inflatable product as claimed in claim 1, further including a cover assembled with the electric pump to prevent the inflatable product from leaking through the electric pump.

7. An inflatable product as claimed in claim 1, wherein the electric pump has first threads and the socket has second threads, by which the electric pump and the socket are screwed together.

8. An inflatable product as claimed in claim 7, wherein the electric pump further has a pad to eliminate gaps between the electric pump and the socket when the electric pump and socket are screwed together.

9. An inflatable product as claimed in claim 1, wherein the electric pump has a lid covering the connector for protecting the connector from water.

10. An inflatable product as claimed in claim 9, further including a switch provided on the electric pump to actuate the electric pump, and the lid also covers the switch.

11. The inflatable product as claimed in claim 1, wherein the pump body can be received partially or wholly in the socket in a first direction for inflating the inflatable body, and received in a second direction for deflating the inflatable body.

12. An inflatable product including:

an inflatable body;

a socket built in the inflatable body;

an electric pump, including a pump body and an air outlet, connected to the socket to pump the inflatable body, wherein the pump body is wholly or partially located in the socket;

at least one battery disposed in the electric pump to supply the electric pump with power;

a switch provided on the electric pump to actuate the electric pump;

a waterproof layer covering the switch to protect the switch from water.

13. The inflatable product as claimed in claim 12, wherein the pump body can be received partially or wholly in the socket in a first direction for inflating the inflatable body, and received in a second direction for deflating the inflatable body.

14. An inflatable product including:

an inflatable body;

a socket built in the inflatable body;

an electric pump, including a pump body and an air outlet, connected to the socket to pump the inflatable body, wherein the pump body is wholly or partially located in the socket;

a connector provided on the electric pump for connecting an external power to actuate the electric pump.

15. The inflatable product as claimed in claim 14, wherein the pump body can be received partially or wholly in the socket in a first direction for inflating the inflatable body, and received in a second direction for deflating the inflatable body.

16. An inflatable product including:

an inflatable body;

a socket built in the inflatable body;

an electric pump, including a pump body and an air outlet, connected to the socket to pump the inflatable body, wherein the pump body is wholly or partially located in tile socket, a portion of the electric pump is inserted into tile socket, and the portion of the electric pump and the socket are matched with each other to prevent an air leakage therebetween.

17. The inflatable product as claimed in claim 16, wherein the pump body can be received partially or wholly in the socket in a first direction for inflating the inflatable body, and received in a second direction for deflating the inflatable body.

* * * * *

US006793469C1

(12) EX PARTE REEXAMINATION CERTIFICATE (7950th)

United States Patent

Chung

(10) Number: US 6,793,469 C1

(45) **Certificate Issued: *Dec. 28, 2010**

(54) INFLATABLE PRODUCT EQUIPPED WITH PUMP

(75) Inventor: Wang Cheng Chung, Taipei (TW)

(73) Assignee: Team Worldwide Corporation, Taipei (TW)

Reexamination Request:
No. 90/008,926, Nov. 19, 2007

Reexamination Certificate for:

| | |
|---|---|
| Patent No.: | **6,793,469** |
| Issued: | **Sep. 21, 2004** |
| Appl. No.: | **09/738,331** |
| Filed: | **Dec. 18, 2000** |

( * ) Notice: This patent is subject to a terminal disclaimer.

Related U.S. Application Data

(63) Continuation-in-part of application No. 09/542,477, filed on Apr. 4, 2000, now Pat. No. 6,332,760.

(51) Int. Cl.
*F04B 17/00* (2006.01)
*F04B 19/00* (2006.01)

(52) U.S. Cl. ..... 417/411; 417/238; 417/423.15

(58) Field of Classification Search ..... None
See application file for complete search history.

(56) References Cited

U.S. PATENT DOCUMENTS

| | | | |
|---|---|---|---|
| 388,037 | A | 8/1888 | Hargin |
| 3,068,494 | A | 12/1962 | Pinkwater |
| 3,112,502 | A | 12/1963 | Forsberg |
| 4,394,784 | A | 7/1983 | Swenson et al. |
| 4,678,014 | A | 7/1987 | Owen et al. |
| 4,702,235 | A | 10/1987 | Hong |
| 4,945,588 | A | 8/1990 | Cassidy et al. |
| 5,057,819 | A | 10/1991 | Valenti |
| 5,068,933 | A | 12/1991 | Sexton |
| 5,216,778 | A | 6/1993 | Suzuki et al. |
| 5,297,545 | A | 3/1994 | Infante |
| 5,367,726 | A | 11/1994 | Chaffee |
| 5,584,084 | A | 12/1996 | Klearman et al. |
| 5,586,347 | A | 12/1996 | Frischknecht |
| 5,606,756 | A | 3/1997 | Price |
| 5,771,514 | A | 6/1998 | Wilhoit |
| 5,794,289 | A | 8/1998 | Wortman et al. |
| 5,827,052 | A | 10/1998 | Wang |
| 5,848,875 | A | 12/1998 | San-Jou |
| 6,119,292 | A | 9/2000 | Haas |
| 6,237,653 | B1 | 5/2001 | Chaffee |
| 6,253,401 | B1 | 7/2001 | Boyd |
| 6,287,095 | B1 | 9/2001 | Saputo et al. |
| 6,312,400 | B1 | 11/2001 | Itikawa |
| 6,315,526 | B1 | 11/2001 | Jones |
| 6,321,400 | B1 | 11/2001 | Gulino |
| 6,457,192 | B2 | 10/2002 | Choi et al. |
| 6,543,073 | B2 | 4/2003 | Wu |
| 6,591,437 | B1 | 7/2003 | Phillips |
| 6,651,283 | B1 | 11/2003 | Cook et al. |
| 6,679,686 | B2 | 1/2004 | Wang |
| 6,722,306 | B1 | 4/2004 | Wang |

(Continued)

FOREIGN PATENT DOCUMENTS

| | | |
|---|---|---|
| DE | 297 21 150 | 3/1998 |

OTHER PUBLICATIONS

Webster'New Universal Unabridged Dictionary, Deluxe 2nd Edition, 1983, p. 1723.*

Supreme Fast–Fill, (Comfort–Rest): Intex Recreation Corp., Long Beach, CA 90801–1440, Instruction Manual, Supreme Fast–Fill Airbed, pp. 1–8, 2000.

*Primary Examiner*—Aaron J. Lewis

(57) ABSTRACT

An inflatable product includes an inflatable body, a socket, an electric pump, at least one battery and a connector. The socket is built in the inflatable body. The electric pump is connected to the socket to pump the inflatable body. The battery is disposed in the electric pump. The connector is provided on the electric pump for connecting an external power. The electric pump is supplied with power by the battery or the external power.

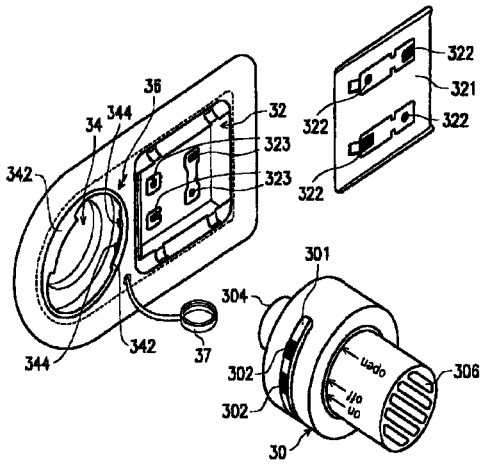

U.S. PATENT DOCUMENTS

| | | | |
|---|---|---|---|
| 6,733,254 | B1 | 5/2004 | Yen |
| 6,793,469 | B2 | 9/2004 | Chung |
| 6,836,914 | B1 | 1/2005 | Tsai |
| 7,025,576 | B2 | 4/2006 | Chaffee |
| 7,039,972 | B2 | 5/2006 | Chaffee |
| 2003/0215340 | A1 | 11/2003 | Chung |
| 2004/0037717 | A1 | 2/2004 | Wang |
| 2005/0079077 | A1 | 4/2005 | Tsai et al. |

* cited by examiner

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1, and 14-17 is confirmed. Claims 2-13 were not reexamined.

* * * * *